US008151619B2

(12) United States Patent
Pyper et al.

(10) Patent No.: US 8,151,619 B2
(45) Date of Patent: Apr. 10, 2012

(54) GUIDED KEEPER ASSEMBLY AND METHOD FOR METAL FORMING DIES

(75) Inventors: Joel T. Pyper, Grand Rapids, MI (US); Scott M. Breen, Grand Rapids, MI (US)

(73) Assignee: Standard Lifters, Inc., Grand Rapids, MI (US)

( * ) Notice: Subject to any disclaimer, the term of this patent is extended or adjusted under 35 U.S.C. 154(b) by 736 days.

(21) Appl. No.: 12/322,473

(22) Filed: Feb. 3, 2009

(65) Prior Publication Data

US 2009/0193865 A1 Aug. 6, 2009

Related U.S. Application Data

(60) Provisional application No. 61/063,535, filed on Feb. 4, 2008.

(51) Int. Cl.
*B21D 24/08* (2006.01)
*B21D 37/00* (2006.01)
*B21J 9/18* (2006.01)

(52) U.S. Cl. ..... 72/456; 72/344; 72/350; 72/453.13; 72/453.14; 72/481.1; 100/214; 100/251

(58) Field of Classification Search ..... 72/344, 72/350, 351, 453.13, 453.14, 455, 456, 481.1; 100/214, 251, 257, 266, 315; 83/138, 140
See application file for complete search history.

(56) References Cited

U.S. PATENT DOCUMENTS

| | | | | |
|---|---|---|---|---|
| 2,627,313 | A | 2/1953 | Marsilius | |
| 2,629,615 | A | 2/1953 | Marsilius | |
| 2,763,325 | A * | 9/1956 | Willous | 83/140 |
| 3,386,781 | A | 6/1968 | Blazek et al. | |
| 3,568,555 | A | 3/1971 | Stroh | |
| 3,664,258 | A | 5/1972 | Vecchi | |
| 3,730,039 | A | 5/1973 | Fedrigo | |
| 3,897,118 | A | 7/1975 | Wolfthal | |
| 4,003,283 | A | 1/1977 | Janiszewski | |
| 4,836,071 | A | 6/1989 | Ersoy | |
| 4,947,717 | A * | 8/1990 | Whistler | 83/138 |
| 5,245,904 | A | 9/1993 | Meyerle | |
| 5,775,212 | A | 7/1998 | Takao | |
| 6,848,290 | B2 * | 2/2005 | Pyper et al. | 72/405.06 |
| 7,000,446 | B2 | 2/2006 | Nieschulz et al. | |
| 7,152,451 | B1 | 12/2006 | Cotter | |
| 7,730,757 | B2 * | 6/2010 | Pyper et al. | 72/456 |
| 7,861,569 | B2 * | 1/2011 | Cotter et al. | 72/351 |
| 7,950,262 | B2 * | 5/2011 | Pyper et al. | 72/456 |
| 8,074,486 | B1 * | 12/2011 | Pyper et al. | 72/456 |
| 2002/0124706 | A1 | 9/2002 | Mochizuki | |

* cited by examiner

*Primary Examiner* — David Jones
(74) *Attorney, Agent, or Firm* — Price Heneveld LLP

(57) ABSTRACT

A guided keeper assembly and method for metal forming dies includes a base having a mounting face, a connector portion and a central aperture. A guide pin has a cylindrical center portion closely received in the central aperture of the base for reciprocation, an enlarged first end with an alignment member, and an outwardly opening circumferential groove. A retainer ring is removably mounted in and protrudes radially outwardly of the groove to securely, yet detachably, retain the base on the guide pin between the enlarged head and the retainer ring in an assembled condition to facilitate transport and mounting of the guided keeper assembly.

49 Claims, 9 Drawing Sheets

GUIDED KEEPER ASSEMBLY AND METHOD FOR METAL FORMING DIES

CLAIM OF PRIORITY

Applicants hereby claim the priority benefits under the provisions of 35 U.S.C. §119, basing said claim of priority on related Provisional Patent Application Ser. No. 61/063,535, filed Feb. 4, 2008.

BACKGROUND OF THE INVENTION

The present invention relates to metal forming dies and the like, in particular to a guided keeper assembly and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed, and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture and repair or modify.

FIGS. 4 and 5 illustrate a prior art metal forming die that includes a die shoe 1 and a die pad 2, which are interconnected for mutual reciprocation by a plurality of spools 3. A spring mechanism 4 is mounted between die shoe 1 and die pad 2, and resiliently urges die pad 2 to a fully extended position. A metal forming die 5 is mounted on the outer surface of die pad 2. Each of the spools 3 includes an enlarged head 6 which reciprocates in an associated counter bore 7 in the bottom of die shoe 1. The heads 6 of spools 3 engage the top of the associated counter bores 7 to positively retain die pad 2 in its fully extended position. The other ends 8 of spools 3 are attached to the corners of die pad 2. While such constructions have been generally successful, they do not precisely control reciprocation between die pad 2 and die shoe 1, particularly in high speed, progressive die applications.

FIGS. 6 and 7 illustrate another prior art configuration, wherein pressed in pins 10, with locator bushings 11, have been added to the spools 3 shown in FIG. 1 to more precisely control the reciprocation between die pad 2 and die shoe 1.

FIGS. 8 and 9 illustrate yet another prior art configuration, which includes guide pins 10 and bushings 11, but substitutes footed keepers 13 and 14 for the common spools 3 to positively limit the reciprocation between die pad 2 and die shoe 1. More specifically, footed keepers 13 are mounted to die pad 2, and engage mating footed keepers 14 which are mounted on die shoe 1.

While such prior art constructions are generally effective, they are complicated and expensive. A modular guided keeper which both precisely aligns the die shoe and die pad, and positively limits reciprocal travel therebetween would be clearly advantageous in simplifying metal forming die constructions and reducing the cost in designing, manufacturing, and repairing the same.

SUMMARY OF THE INVENTION

One aspect of the present invention is a metal forming die of the type having a die shoe, a die pad mounted a spaced apart distance from the die shoe for mutual reciprocation between converged and diverged positions, and a biasing member disposed between the die shoe and the die pad for biasing the same to the diverged position. The metal forming die includes at least one guided keeper assembly, comprising a base having a mounting face shaped to abut an adjacent face of the die shoe, a connector portion for detachably mounting the base to the die shoe, and a central aperture extending axially through the base. The guided keeper assembly also includes a guide pin having a cylindrically-shaped central portion closely received in the central aperture in the base for precisely guiding reciprocal motion between the die pad and the die shoe, a first end having an enlarged head shaped to abut the mounting face of the base to positively limit travel between the die shoe and die pad, and a second end positioned opposite the first end, and having an alignment member configured to precisely locate the second end of the guide pin on the die pad, as well as an outwardly opening groove extending circumferentially about the second end of the guide pin. The guided keeper assembly also includes a retainer ring removably mounted in the groove and protruding radially outwardly of the second end of the guide pin to securely, yet detachably, retain the base on the guide pin between the enlarged head and the retainer ring in an assembled condition to facilitate transport and mounting of the guided keeper assembly. The guided keeper assembly also includes a first fastener operably engaging the connector portion of the base and securely, yet detachably, connecting the base with the die shoe, as well as a second fastener securely, yet detachably, connecting the second end for the guide pin with the die pad.

Another aspect of the present invention is a guided keeper assembly for metal forming dies of the type having a die shoe, a die pad mounted a spaced apart distance from the die shoe for mutual reciprocation between converged and diverged positions, and a biasing member disposed between the die shoe and the die pad for biasing the same to the diverged position. The guided keeper assembly includes a base having a mounting face shaped to abut an adjacent face of the die shoe, a connector portion for detachably mounting the base to the die shoe, and a central aperture extending axially through the base. The guided keeper assembly also includes a guide pin having a cylindrically-shaped central portion closely received in the central aperture in the base for precisely guiding reciprocal motion between the die pad and the die shoe, a first end having an enlarged head shaped to abut the mounting face of the base to positively limit travel between the die shoe and die pad, and a second end positioned opposite the first end, and having an alignment member configured to precisely locate the second end of the guide pin on the die pad, and an outwardly opening groove extending circumferentially about the second end of the guide pin. The guided keeper assembly also includes a retainer ring removably mounted in the groove and protruding radially outwardly of the second end of the guide pin to securely, yet detachably, retain the base on the guide pin between the enlarged head and the retainer ring in an assembled condition to facilitate transport and mounting of the guided keeper assembly. The guided keeper assembly also includes a first fastener operably engaging the connector portion of the base and securely, yet detachably, connecting the base with the die shoe, as well as a second fastener securely, yet detachably, connecting the second end of the guide pin with the die pad.

Yet another aspect of the present invention is a method for making a metal forming die of the type having a die shoe, a die pad mounted a spaced apart distance from the die shoe for mutual reciprocation between converged and diverged positions, and a biasing member disposed between the die shoe and the die pad for biasing the same to the diverged position. The method includes forming a base with a mounting face shaped to abut an adjacent face of the die shoe, at least one connector portion for detachably mounting the base to the die shoe, and a central aperture extending axially through a central portion of the base. The method further includes forming a guide pin with a cylindrically-shaped central portion shaped for close reception in the central aperture in the base, a first end with an enlarged head shaped to abut the mounting face of the base block to positively limit travel between the die shoe and die pad, and a second end with an alignment member to precisely locate the second end of the guide pin on the die pad. The method further includes forming at least one fastener aperture in the die shoe at a preselected location, and forming an outwardly open groove circumferentially about the second end of the guide pin. The method further includes inserting the central portion of the guide pin into the central opening in the base for precisely guiding reciprocal motion between the die pad and the die shoe, and mounting a retainer ring in the groove on the guide pin, such that the retainer ring protrudes radially outwardly of the second end of the guide pin to securely, yet detachably, retain the base on the guide pin between the enlarged head and the retainer ring in an assembled condition to facilitate transport and mounting of the guided keeper assembly. The method further includes engaging a fastener with a connector portion of the base and engaging the same in the fastener aperture in the die shoe to securely, yet detachably, mount the base on the die shoe. The method further includes engaging the alignment member on the second end of the guide pin with the die pad to precisely locate the second end of the guide pin in the die pad, and securely, yet detachably, connecting the second end of the guide pin with the die pad.

Yet another aspect of the present invention is guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position. The guided keeper assembly includes a base bushing having a generally annular configuration defined by a cylindrically-shaped outer wall, a cylindrically-shaped inner wall, an upper end and a lower end. The base bushing also has an outwardly opening groove extending circumferentially about the outer wall at a location thereon adjacent to the upper end of the base bushing. The base bushing also includes an annularly-shaped mounting flange protruding radially outwardly of the outer wall at a location between the groove and the lower end of the base bushing, and having a radially extending first face configured to abut the die shoe, and an oppositely oriented radially extending second face. The guided keeper assembly also includes a guide pin having a cylindrically-shaped central portion closely received in the inner wall of the base bushing for precisely guiding reciprocal motion between the die pad and the die shoe, as well as a first end having an enlarged head shaped to abut one of the upper end and the lower end of base bushing to positively limit travel between the die shoe and the die pad. The guided keeper assembly also includes at least one flange clamp having a fastener aperture extending through a marginal portion thereof and radially inwardly projecting lip which abuttingly engages an adjacent portion of the second face of the mounting flange for detachably mounting the base bushing to the die shoe. The guided keeper assembly also includes a fastener having a head portion, and a shank portion extending through the fastener aperture in the flange clamp for securely, yet detachably, connecting the base bushing with the die shoe. The guided keeper assembly also includes a retainer ring detachably mounted in the groove and protruding radially outwardly of the outer wall of the base bushing to a position immediately above and adjacent to the head portion of the fastener to positively prevent the fastener from being inadvertently removed from engagement with the die shoe.

Yet another aspect of the present invention is a guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position. The guided keeper assembly includes a base having a mounting face shaped to abut an adjacent face of the die shoe, a connector portion for detachably mounting the base to the die shoe, and a central aperture extending axially through a central portion of the base. The guided keeper assembly also includes a guide pin having a cylindrically-shaped central portion closely received in the central aperture in the base for precisely guiding reciprocal motion between the die pad and the die shoe. The guide pin also has a first end having an enlarged head shaped to abut the mounting face of the base to positively limit travel between the die shoe and the die pad. The guide pin also has a second end, positioned opposite the first end, and having a shoulder with a rigid center post protruding outwardly therefrom to precisely locate the second end of the guide pin in the die pad. The guide pin has an axially extending threaded aperture through a lower portion thereof, and a non-circular plan shape for reception in a similarly shaped socket in the die shoe. The guided keeper assembly also includes a first fastener engaging the connector portion of the base, and securely, yet detachably, connecting the base with the die shoe. The guided keeper assembly also includes a second fastener having a generally cylindrically-shaped head portion with at least one threaded aperture extending axially through a marginal portion thereof, and threaded shank portion threadedly received in the threaded aperture of the guide pin. The guided keeper assembly also includes a set screw threadedly mounted in the threaded aperture of the head portion of the second fastener, and including an interior end shaped to abuttingly engage the recess in the die shoe to prevent inadvertent loosening of the second fastener.

Yet another aspect of the present invention is a guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position. The guided keeper assembly includes a base having a mounting face shaped to abut an adjacent face of the die shoe, a connector portion for detachably mounting the base to the die shoe, and a central aperture extending axially through the base. The guided keeper assembly also includes a guide pin having a cylindrically-shaped central portion closely received in the central aperture in the base for precisely guiding reciprocal motion between the die pad and the die shoe, and having a centrally disposed longitudinal axis. The guide pin also has a first end having an enlarged head shaped to abut the mounting face of the base to positively limit travel between the die shoe and die pad. The guide pin also has a second end, positioned opposite the first end, and including a generally flat, circularly-shaped end face disposed perpendicular with the longitudinal axis of the central portion, and having a center disposed concentric with the longitudinal axis of the center portion. The second end of the guide pin also includes a first threaded fastener aperture extending through the end face and axially into the central portion in a perpendicular relationship with the end face at an eccentric location spaced from the center of the end face. The second end of the guide pin also includes a second threaded fastener aperture extending perpendicularly through the end face and radially into the central portion at an eccentric location spaced apart from the center of the end face, and generally opposite the first threaded fastener aperture. The second end of the guide pin also includes at least one unthreaded locator aperture extending perpendicularly through the end face and axially into the second end. The guided keeper assembly also includes at least one unthreaded locator pin having an interior end thereof closely received in the locator aperture at an exterior end shaped for close reception in an alignment aperture in the die pad to precisely, yet detachably, mount the guided keeper assembly thereon.

Yet another aspect of the present invention is to provide a metal forming die and associated guided keeper assembly that has a small, compact footprint, with a heavy-duty construction that is very durable. The guided keeper assembly has a modular configuration that facilitates economical manufacture, and also simplifies metal forming die constructions to reduce the effort and cost of designing, manufacturing, repairing and/or modifying the same. Machine downtime is also minimized to realize yet additional efficiency. The guided keeper assembly is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
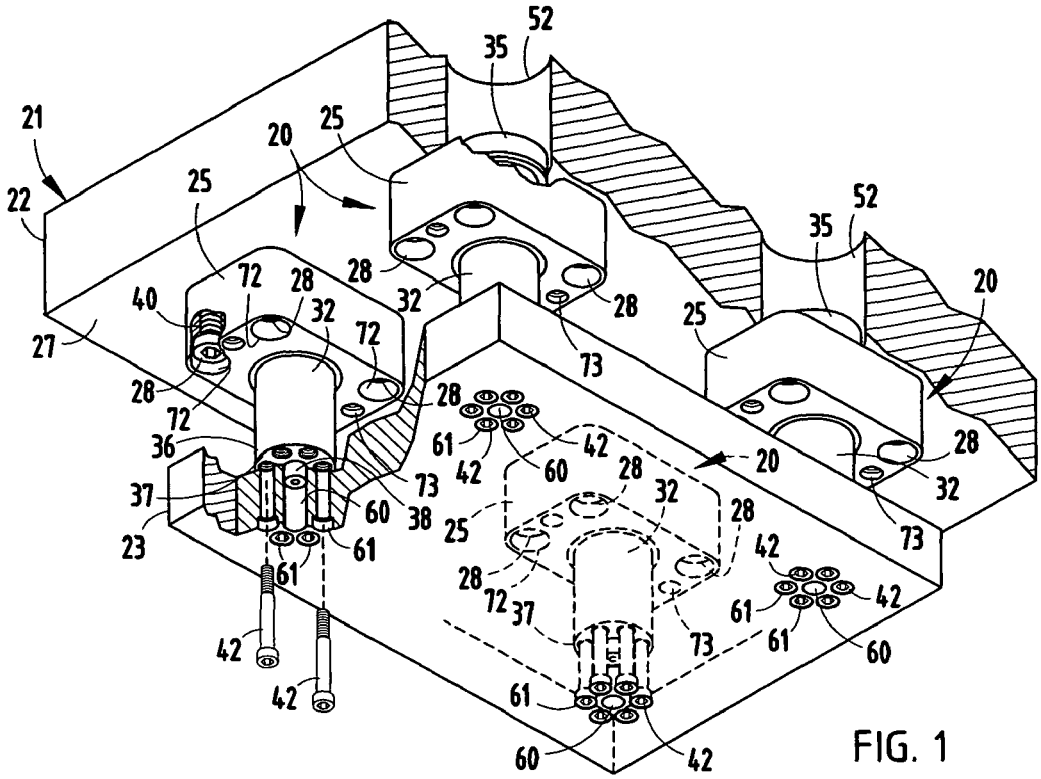
FIG. 1 is a perspective view of a die shoe and die pad interconnected by four guided keeper assemblies embodying the present invention, wherein portions of the die pad and die shoe have been broken away to reveal internal construction.
Figure 2:
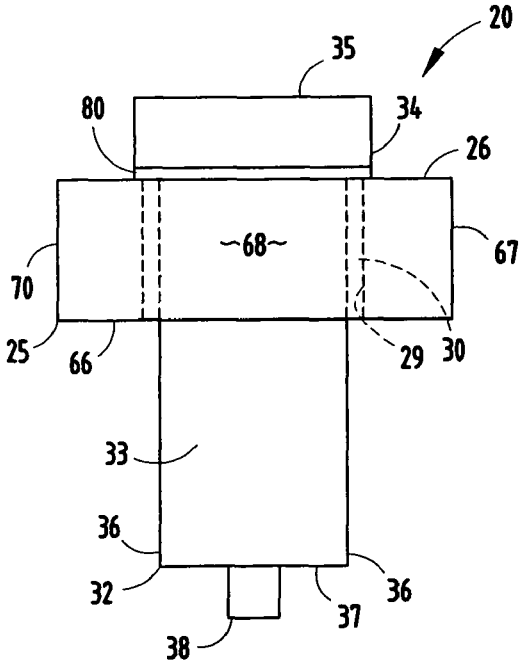
FIG. 2 is a side elevational view of one of the guided keeper assemblies embodying the present invention.

For purposes of description herein, the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
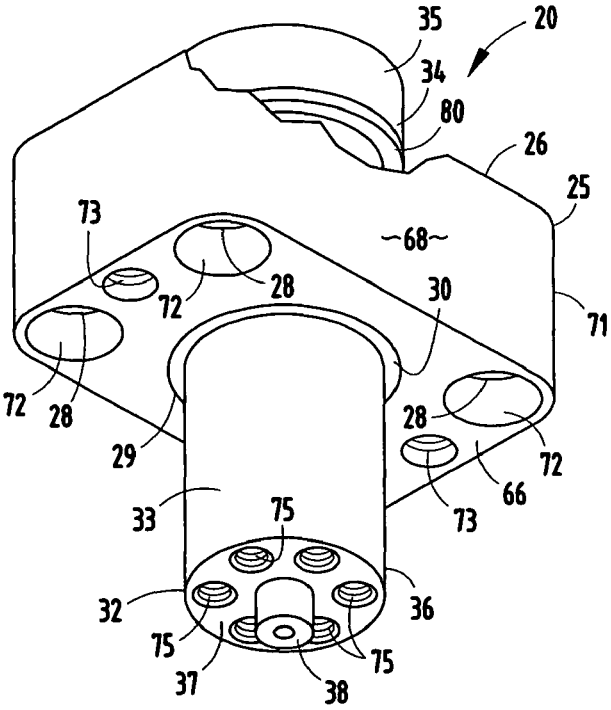
FIG. 3 is a bottom perspective view of the guided keeper assembly shown in FIG. 2, wherein a portion thereof has been broken away to reveal internal construction.
Figure 4:
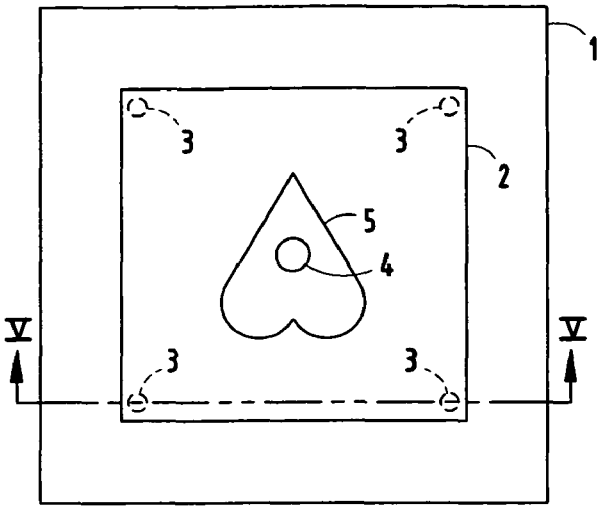
FIG. 4 PRIOR ART
FIG. 4 is a partially schematic, plan view of a prior art metal forming die.
Figure 5:
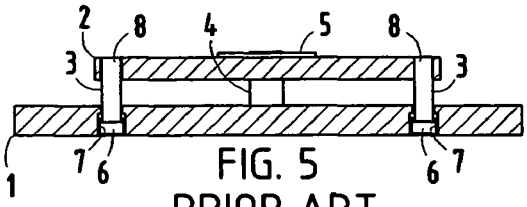
FIG. 5 PRIOR ART
FIG. 5 is a side elevational view of the prior art metal forming die shown in FIG. 4.
Figure 6:
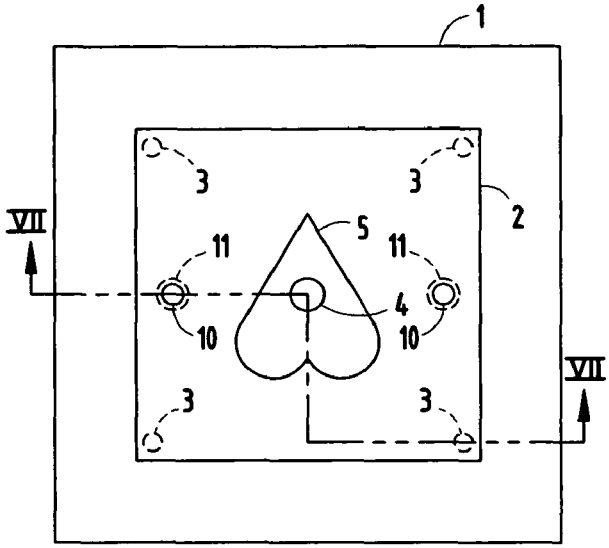
FIG. 6 PRIOR ART
FIG. 6 is a partially schematic plan view of an alternative prior art metal forming die.
Figure 7:
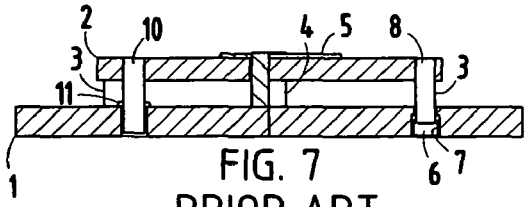
FIG. 7 PRIOR ART
FIG. 7 is a side elevational view of the prior art metal forming die shown in FIG. 6.
Figure 8:
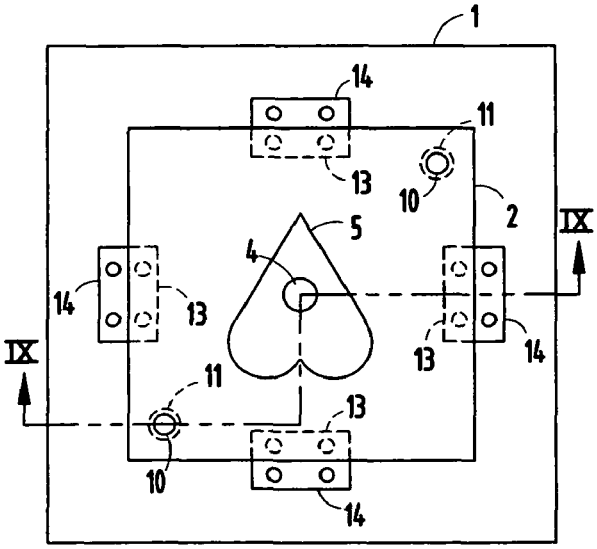
FIG. 8 PRIOR ART
FIG. 8 is a partially schematic plan view of yet another alternative prior art metal forming die.
Figure 9:
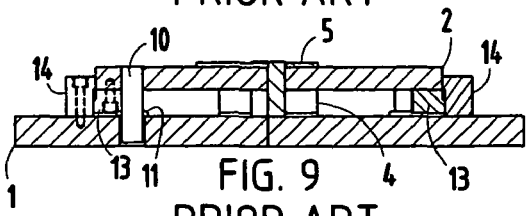
FIG. 9 PRIOR ART
FIG. 9 is a side elevational view of the prior art metal forming die shown in FIG. 8.
Figure 17:
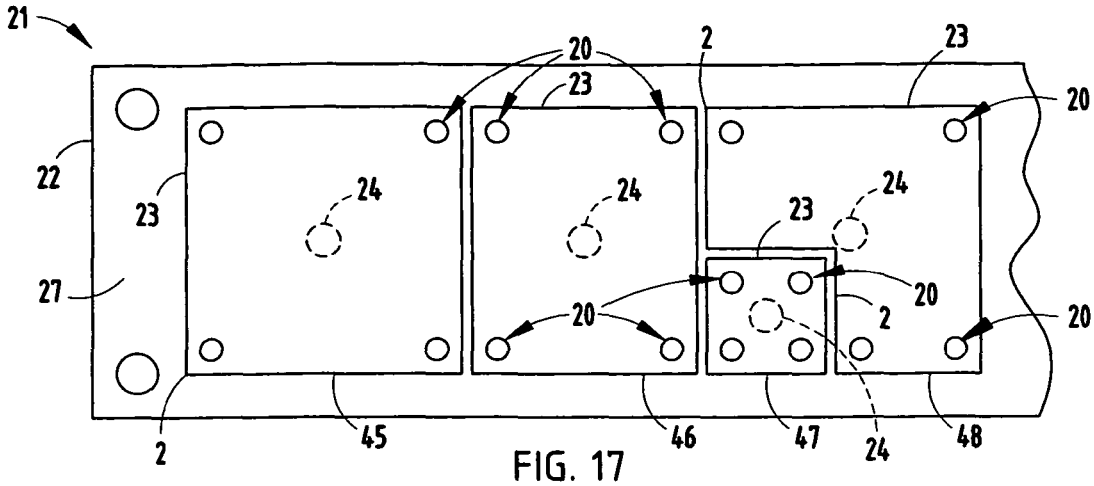
FIG. 17 is a partially schematic plan view of a metal forming die having a plurality of stations each with die pads connected to the die shoe by the guided keeper assemblies.
Figure 18:
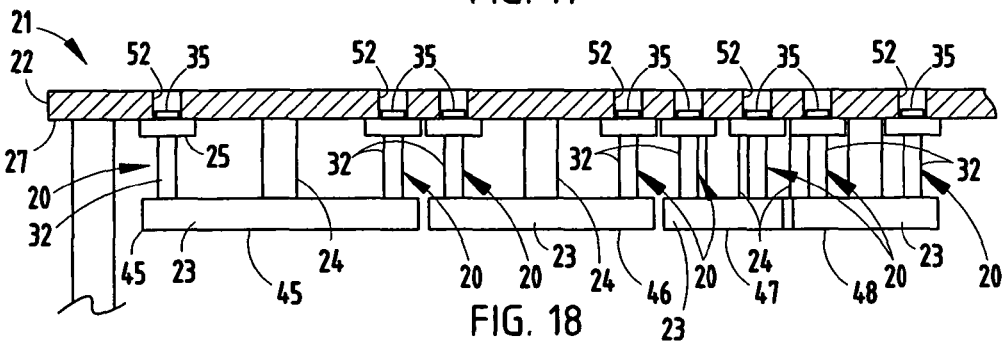
FIG. 18 is a partially schematic side elevational view of the metal forming die shown in FIG. 17.

The reference numeral 20 (FIGS. 1-3) generally designates a guided keeper assembly embodying the present invention, which is particularly adapted for use in conjunction with metal forming dies, such as the die set or die 21 illustrated in FIG. 1, having a die shoe 22 and a die pad 23 mounted a spaced apart distance from die shoe 22 for reciprocation between converged and diverged positions. A biasing member 24, which is schematically illustrated in FIGS. 17 and 18, is disposed between die shoe 22 and die pad 23 for biasing the same to the diverged position. Guided keeper assembly 20 (FIGS. 1-3) includes a base block 25 having a generally flat mounting face 26 abutting an adjacent face 27 of die shoe 22. Base block 25 has at least one non-threaded fastener aperture 28 extending axially through a marginal portion of base block 25 for detachably mounting base block 25 to die shoe 22. Base block 25 also includes a central aperture 29 extending axially through a central portion of base block 25, and a bushing 30 mounted in the central aperture 29 of base block 25. Guided keeper assembly 20 also includes a guide pin 32 having a cylindrically-shaped central portion 33 closely received in bushing 30 in base block 25 for precisely guiding reciprocal motion between die pad 23 and die shoe 22. Guide pin 32 also includes a first end 34 having an enlarged head 35 shaped to abut the mounting face 26 of base block 25 to positively limit travel between die shoe 22 and die pad 23. Guide pin 32 also includes a second end 36, positioned opposite the first end 34, and having a shoulder 37 with a rigid center post 38 protruding outwardly therefrom to precisely locate the second end 36 of guide pin 32 in die pad 23. A first fastener 40 extends through the fastener aperture 28 in base block 25 and securely, yet detachably, connects base block 25 with die shoe 22. A second fastener 42 securely, yet detachably, connects the second end 36 of guide pin 32 with die pad 23.

In the example illustrated in FIGS. 17 and 18, die 21 is an upper die half, and includes four separate stations 45-48, each having a separate die pad 23 attached to a common upper die shoe 22 by a plurality of guided keeper assemblies 20. In the illustrated example, each of the die pads 23 is attached to the common die shoe 22 by four guided keeper assemblies 20 disposed adjacent corner portions of the die pads 23. However, it is to be understood that the precise number of guided keeper assemblies and their particular location on the die pad 23 will vary in accordance with the particular application. Also, guided keeper assemblies 20 can be used on the lower die shoe, and other similar applications, as will be apparent to those skilled in the art.

Figure 10:
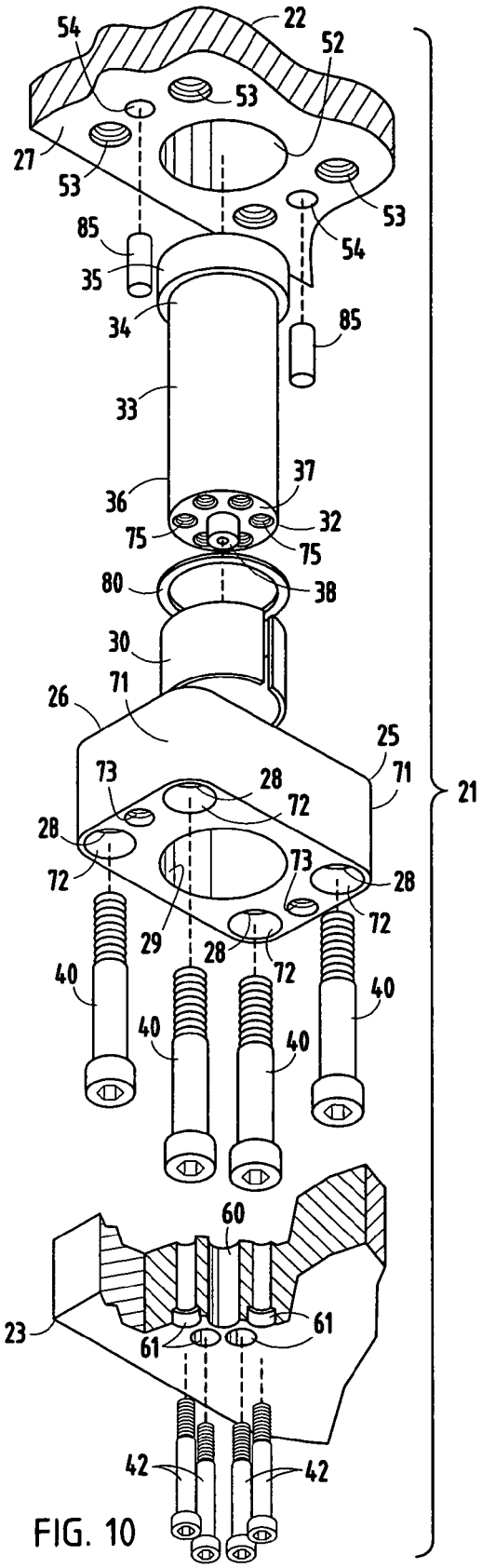
FIG. 10 is an exploded perspective view of the guided keeper assembly shown with associated fragmentary portions of the die shoe and die pad.
Figure 11:
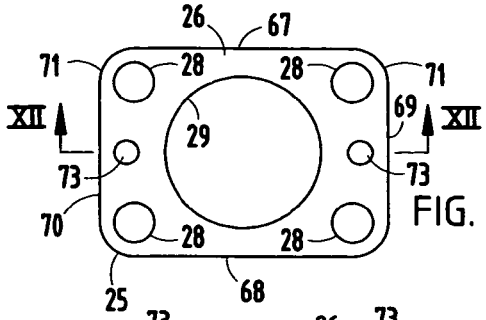
FIG. 11 is a top plan view of a base block portion of the guided keeper assembly.
Figure 12:
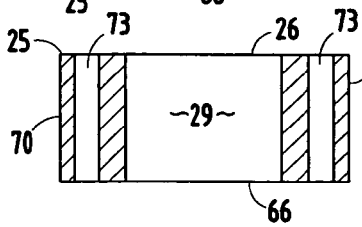
FIG. 12 is a vertical cross-sectional view of the base block taken along the line XII-XII, FIG. 11.
Figure 13:
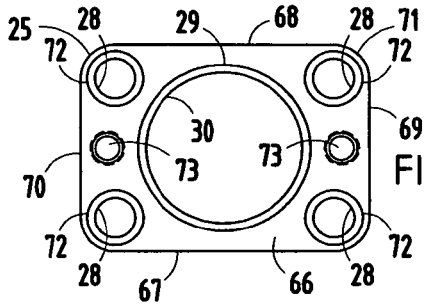
FIG. 13 is a bottom plan view of the base block.

As best illustrated in FIG. 10, at each position or location the guided keeper assembly 20 is to be installed, die shoe 22 is prepared in the following manner. A circular clearance or through hole 52 is formed through die shoe 22 in vertical axial alignment with the position at which the guided keeper assembly 20 is to be installed. Through hole 52 has a diameter slightly larger than the head 35 of guide pin 32 to permit free reciprocation of guide pin 32 therein. The formation of through hole 52 is relatively simple, since it can be formed in a single boring operation, and need not be precise, since there is substantial clearance between the head 35 of guide pin 32 and the interior of through hole 52.

In the example illustrated in FIG. 10, four threaded fastener apertures 53 are formed in the surface 27 of die shoe 22, and are arranged around through hole 52 in a quadrilateral pattern for purposes to be described in greater detail hereinafter. Also, in the embodiment illustrated in FIG. 10, two locator apertures 54 are formed in the surface 27 of die shoe 22 on opposite sides of through hole 52 to precisely locate base block 25 on die shoe 22 in the manner described in greater detail hereinafter. Preferably, locator apertures 54 are reamed to provide improved precision.

In the arrangement illustrated in FIG. 10, die pad 23 is prepared in the following manner. A precision circular locator aperture 60 is formed through die pad 23 at a position in vertical alignment with the location at which the guided keeper assembly 20 is to be installed. Locator aperture 60 is a through hole, and is formed with a precise diameter shaped through reaming or the like, to closely receive the center post 38 of guide pin 32 therein to accurately locate the second end 36 of guide pin 32 on die pad 23. In the illustrated example, six non-threaded fastener apertures 61 are formed through die pad 23, and are arranged in a circumferentially spaced apart pattern that is concentric with the locator aperture 60. Fastener apertures 61 have enlarged outer ends to receive the heads of fasteners 42 therein, and serve to securely, yet detachably, mount the second end 36 of guide pin 32 to die pad 23 in a manner described in greater detail hereinafter.

The illustrated base block 25 (FIGS. 10-13) is made from steel, and has a generally rectangular plan configuration defined by an upper surface 26, a lower surface 66 and sidewalls 67-70 which intersect at radiused corners 71. The illustrated base block 25 includes four non-threaded fastener apertures 28 positioned adjacent each of the corners 71 of base block 25. Fastener apertures 28 are mutually parallel and are arranged in a rectangular pattern identical to that of the threaded fastener apertures 53 on die shoe 22, such that fastener apertures 28 are in vertical alignment with threaded fastener apertures 53. The lower or die pad ends of fastener apertures 28 have enlarged counter bored portions 72 to receive therein the heads of fasteners 40. The illustrated base block 25 also includes two locator apertures 73 which are formed through base block 25 and are arranged in a mutually parallel relationship for vertical alignment with the locator apertures 54 in die shoe 22. The illustrated base block 25 has a relatively small, compact plan configuration to facilitate die manufacture, and also permits the same to be pocketed or recessed into the die shoe 22, if necessary, for a specific application.

The illustrated bushing 30 (FIG. 10) is a maintenance-free split bushing, constructed from a suitable antifriction material, such as bronze, steel alloys or the like. In the uninstalled condition, the outside diameter of bushing 30 is slightly larger than the interior diameter of central aperture 29, such that bushing 30 is press fit into the central aperture 29 of base block 25 and is securely retained therein by a friction fit. The inside diameter of bushing 30 is slightly greater than the outside diameter of the central portion 33 of guide pin 32, such as 0.0010-0.0020 inches, to accommodate for thermal expansion between the guide pin 32 and the bushing 30, yet maintain precise reciprocal alignment between die shoe 22 and die pad 23. The use of a separate bushing 30 permits base block 25 to be made from high strength steel and the like, thereby providing a much stronger assembly than those constructed from a single, softer material, such as bonze or the like.

As will be appreciated by those skilled in the art, bushing 30 may be formed integrally into base block 25, or omitted entirely by forming the bearing or guide surface for guide pin 32 in base block 25. For example, base block 25 could be constructed from bronze, or other similar antifriction materials, such that central aperture 29 itself forms the guide surface. Alternatively, the central aperture 29 of base block 25 can be plated or otherwise coated with an antifriction material to eliminate the need for a separate bushing 30.

Figure 14:
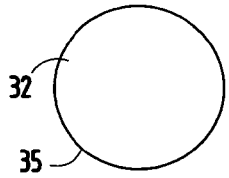
FIG. 14 is a top plan view of a guide pin portion of the guided keeper assembly.
Figure 15:
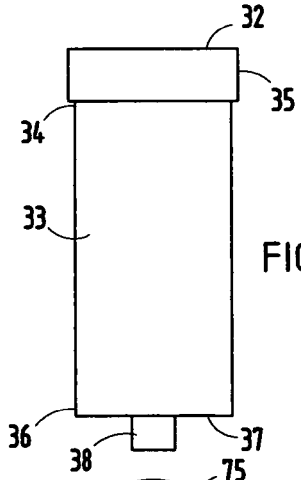
FIG. 15 is a side elevational view of the guide pin.
Figure 16:
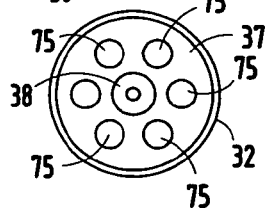
FIG. 16 is a bottom plan view of the guide pin.

The illustrated guide pin 32 (FIGS. 10 and 14-16) has a generally cylindrical shape, which in the orientation illustrated in FIGS. 14-16, has enlarged head 35 attached to the upper or first end 34 of guide pin 32 and center post 38 protruding downwardly from the lower or second end 36 of guide pin 32. The illustrated shoulder 37 and center post 34 are formed integrally in the lower end 36 of guide pin 32, and center post 37 is precisely located at the center of shoulder 37 in a concentric relationship. The lowermost end of the illustrated center post 38 is flat with a circular indentation at the center which facilitates precise location and formation of center post 38 on guide pin 32. The illustrated center post 38 is accurately machined to a tolerance of 0.0-0.0005 inches. In the example illustrated in FIGS. 10 and 14-16, six threaded fastener apertures 75 are formed in the flat, radially extending shoulder 37 of guide pin 32 in a circumferentially spaced apart pattern that is concentric with center post 38. Threaded fastener apertures 75 are positioned to align vertically with the six non-threaded fastener apertures 61 and die pad 23. In one working embodiment of the present invention, guide pin 32 is constructed from pre-hardened 4140 steel, or the like, is cut to length and formed, and then case hardened and polished.

With reference to FIG. 10, the illustrated guided keeper assembly 20 includes an annularly-shaped, resilient washer or ring 80 that is disposed on guide pin 32 between enlarged head 35 and the mounting face 26 of base block 25. Resilient washer 80 serves to absorb impact between head 35 and base block 25 during operation, and can be constructed from urethane, or the like.

In operation, guided keeper assemblies 20 are used to quickly and easily interconnect die shoe 1 and die pad 2 for reciprocation between converged and diverged positions. At least two guided keeper assemblies 20 are typically used to mount die pad 2 to die shoe 1. However, it is to be understood that the specific number of guided keeper assemblies 20 used depends upon the specific die application. In any event, the die shoe 1 is prepared in the manner described hereinabove by providing the clearance or through hole 52, four threaded fastener apertures 53 and two locator apertures 54 at each location at which guided keeper assembly 20 is to be installed. Similarly, die pad 2 is prepared by forming one locator aperture 60 and six unthreaded fastener apertures 61 at each location guided keeper assembly 20 is to be installed. The base blocks 25 are then mounted to the surface 27 of die shoe 22 at each of the designated locations by installed threaded fasteners 40 which are then inserted through fastener apertures 28 and anchored in the threaded fastener apertures 53 in die shoe 22. The illustrated fasteners 40 are cap screws with nylon pellets which resist inadvertent loosening in die shoe 22. Alignment dowels or pins 85 may be mounted in die shoe 22 and received in locator apertures 54 and 72 to achieve additional precision in locating base blocks 25 on die shoe 22. Guide pins 32, with resilient washers 80 installed thereon, are then inserted through the bushings 30 in each of the base blocks 25. The center post 38 at the lower end 36 of each guide pin 32 is received closely within the locator apertures 60 in die pad 23. Threaded fasteners 42 are then inserted through the fastener apertures 61 in die pad 23 and anchored in the threaded fastener apertures 75 in the shoulder portion 37 of guide pin 32 to securely, yet detachably, connect the lower end of guide pin 32 with die pad 23.

Figure 19:
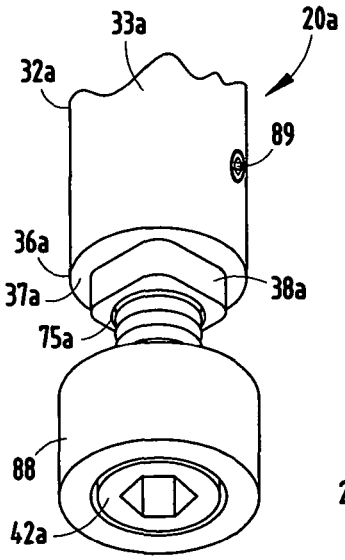
FIG. 19 is a fragmentary, perspective view of a second embodiment of the present invention.
Figure 20:
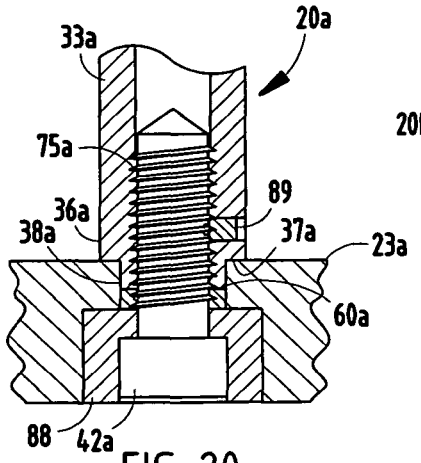
FIG. 20 is a fragmentary, vertical cross-sectional view of the guided keeper assembly shown in FIG. 19, illustrated attached to a die pad.
Figure 21:
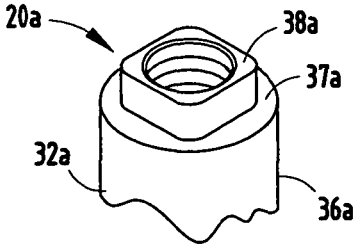
FIG. 21 is a fragmentary, top perspective view of a guide pin portion of the guided keeper assembly shown in FIGS. 19 and 20.

The reference numeral 20*a* (FIGS. 19-21) generally designates another embodiment of the present invention, having a single fastener 42*a* at the shoulder end 36*a* of guide pin 32*a*. Since guided keeper assembly 20*a* is similar to the previously described guided keeper assembly 20, similar parts appearing in FIGS. 20-21, 1-3 and 10-16, respectively, are represented by the same, corresponding reference numerals, except for the suffix "a" in the numerals of the latter. In guided keeper assembly 20*a*, the lower or shoulder end 36*a* of guide pin 32*a* includes a center post 38*a* having a non-circular plan configuration, which is designed to prevent rotation of guide pin 32*a* relative to the associated die pad 23*a*. In the illustrated example, the center post 38*a* of guide pin 32*a* has a generally square plan configuration with radiused or rounded corners. Furthermore, a single threaded fastener aperture 75*a* is formed concentrically through shoulder 37*a* and into guide pin 32*a*, and is adapted to receive therein a single threaded fastener 42*a* along with annularly-shaped cap or locking collar 88. A set screw 89 extends radially through the side of guide pin 32*a* to facilitate removal of base block 25, and positively retain fastener 42*a* in threaded fastener aperture 75*a*. Die pad 23*a* is prepared with a non-circular locator aperture 60*a* to closely receive the center post 38*a* of guide pin 32*a* therein and prevent axial rotation therebetween.

Figure 22:
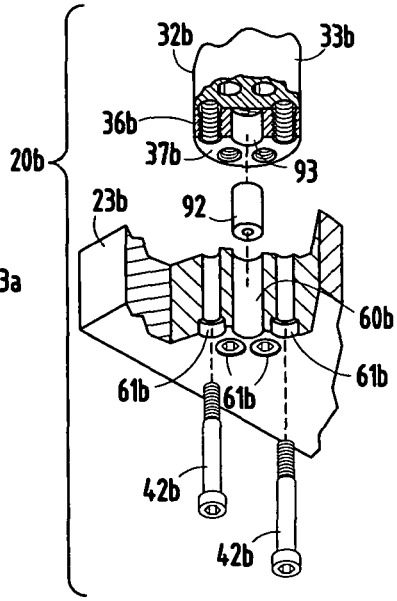
FIG. 22 is an exploded side elevational view of a third embodiment of the present invention having an alignment pin connecting the guide pin with the die pad.
Figure 23:
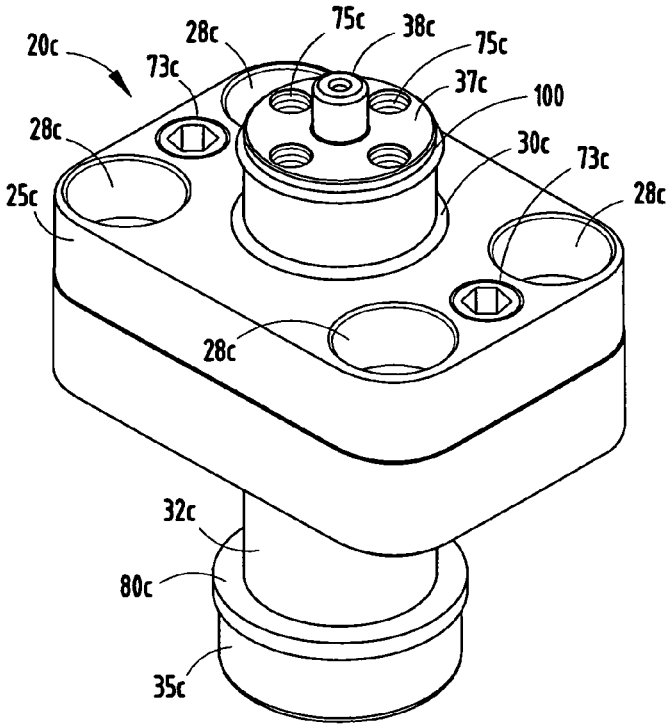
FIG. 23 is a perspective view of a fourth embodiment of the present invention having a retainer ring which retains the base on the guide pin in an assembled condition.

The reference numeral 20*b* (FIG. 22) generally designates yet another embodiment of the present invention having a removable locator pin 92 at the shoulder end 36*b* of guide pin 32*b*. Since guided keeper assembly 20*b* is similar to the previously described guided keeper assembly 20, similar parts appearing in FIG. 22, FIGS. 1-3 and 10-16, respectively, are represented by the same, corresponding reference numerals, except for the suffix "b" in the numerals of the latter. In guided keeper assembly 20*b*, a cylindrical recess 93 is formed in the end 37*b* of guide pin 32*b*, instead of center post 38*b*. In the illustrated example, recess 93 has a generally circular plan configuration, and is precisely formed in the center of the shoulder 37*b* of guide pin 32*b*. A mating through aperture 60*b* is formed through die pad 23*b* in vertical alignment with recess 93. A separate, cylindrical locator pin 92 has one end closely received in recess 93, and the opposite end closely received in locator aperture 60*b*, so as to precisely locate the shoulder end 36*b* of guide pin 32*b* in die pad 23*b*.

Figure 24:
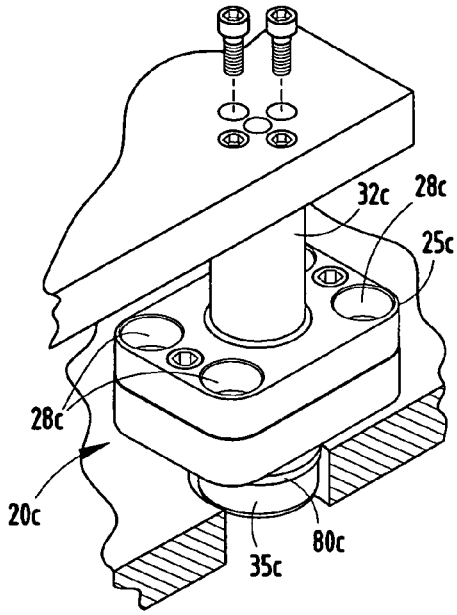
FIG. 24 is a perspective view of the guided keeper assembly shown in FIG. 23, illustrated being attached to an associated die.
Figure 25:
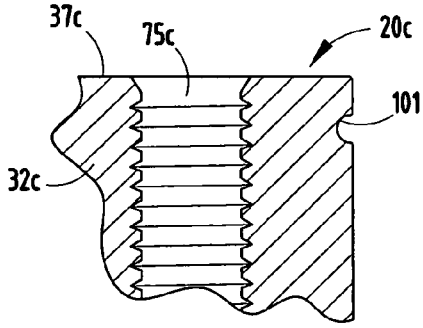
FIG. 25 is an enlarged, fragmentary cross-sectional view of a guide pin portion of the guided keeper assembly shown in FIGS. 23 and 24.
Figure 26:
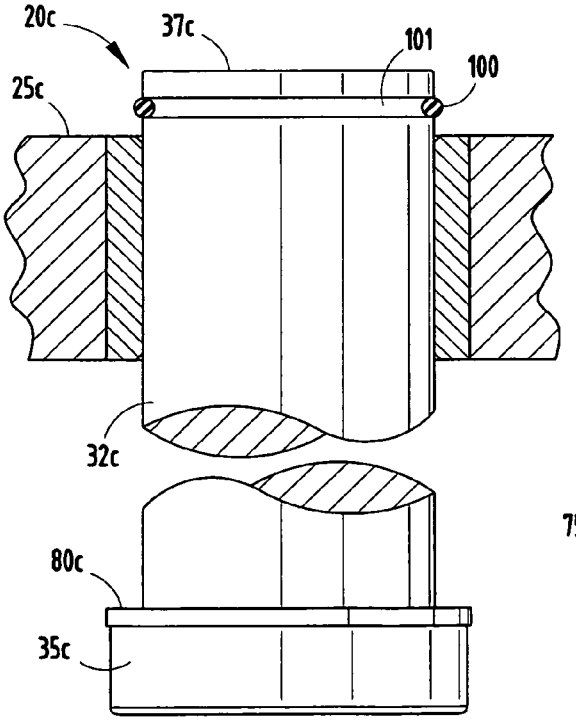
FIG. 26 is a fragmentary cross-sectional view of the guided keeper assembly shown in FIGS. 23-25.
Figure 27:
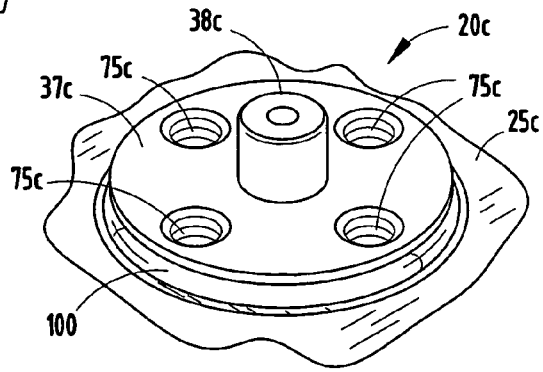
FIG. 27 is an enlarged, fragmentary view of the guided keeper assembly shown in FIGS. 23-26.
Figure 28:
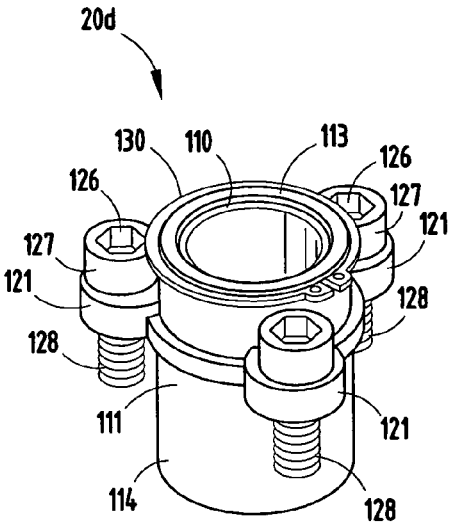
FIG. 28 is a perspective view of a fifth embodiment of the present invention having a base bushing.

The reference numeral 20*c* (FIGS. 23-27) generally designates yet another embodiment of the present invention having a retainer ring 100 which retains the base 25*c* on the guide pin 32*c* between the enlarged head 35*c* and the retainer ring 100 in an assembled condition to facilitate transport and mounting of the guided keeper assembly 20*c*. Since guided keeper assembly 20*c* is similar to the previously described guided keeper assembly 20, similar parts appearing in FIGS. 23-27 and FIGS. 1-18, respectively, are represented by the same, corresponding reference numerals, except for the suffix "c" in the numerals of the latter. In guided keeper assembly 20*c*, a radially outwardly opening groove 101 extends circumferentially about the second end 36*c* of guide pin 32*c*. As best illustrated in FIG. 25, groove 101 has a generally U-shaped configuration, and is positioned axially immediately adjacent to the flat shoulder 37*c* on guide pin 32*c* to avoid interfering with the reciprocation of die pad 2*c*. Retainer ring 100 is removably mounted in groove 101 and protrudes radially outwardly of the second end 36*c* of guide pin 32*c* to securely, yet detachably, retain base 25*c* on guide pin 32*c* between head 35*c* and retainer ring 100 in an assembled condition to create a semi-permanent assembly which facilitates transport and mounting of the guided keeper assembly 20*c*. The base 25*c*, guide pin 32*c* and washer 80*c* can be disassembled only after removal of retainer ring 100 from guide pin grove 101. In the illustrated example, retainer ring 100 comprises a resilient ring sized to selectively snap fit into groove 101. In one example of the present invention, retainer ring 100 is a flexible O-ring that is constructed from a relatively soft material so as to absorb impact with base 25*c*. As in guided keeper assembly 20, a resilient washer 80*c* is disposed on guide pin 32*c* between enlarged head 35*c* and the mounting face 26*c* of base 25*c* to absorb impact therebetween. The illustrated guided keeper assembly 1*c* has a block-shaped base block 25*c*, and is mounted to an associated die shoe 1*c* in a manner similar to that described above relative to guided keeper assembly 20. Guided keeper assembly 20*c* is particularly beneficial when the same is mounted to a die member in the orientation illustrated in FIG. 24, where the head 35*c* of guide pin 32*c* is oriented downwardly, and the alignment end 36*c* is oriented upwardly. When guide pin 32*c* is unbolted from die block 1*c*, O-ring 100 prevents the guide pin 32*c* from falling through base 25*c*.

The reference numeral 20*d* (FIGS. 28-36) generally designates yet another embodiment of the present invention having a bushing style base 110. Since guided keeper assembly 20*d* is similar to the previously described guided keeper assembly 20, similar parts appearing in FIGS. 28-36 and FIGS. 1-18, respectively, are represented by the same, corresponding reference numerals, except for the suffix "d" in the numerals of the latter. The illustrated base style bushing 110 has a generally annular configuration defined by a cylindrically-shaped outer wall 111, a cylindrically-shaped inner wall 112, an upper end 113 and a lower end 114. An outwardly opening groove 115 extends circumferentially about outer wall 111 at a location thereon adjacent to the upper end 113 of base bushing 110. An annularly-shaped mounting flange 116 protrudes radially outwardly from the outer wall 111 of base bushing 110 at a location thereon between groove 115 and the lower end 114 of base bushing 110, and has a radially extending first face 118 configured to abut the die shoe 1*d*, and an oppositely oriented, radially extending second face 119. Guided keeper assembly 20*d* also includes a plurality of heavy-duty flange clamps 121, each of which has a fastener aperture 122 extending through a marginal portion 123 thereof and a radially inwardly projecting lip 124 which abuttingly engages an adjacent portion of the second face 119 of mounting flange 116 for detachably mounting base bushing 110 to die shoe 1*d*. Flange clamps 121 are preferably designed to exceed the strength of the guide pin connection, and provide a very economical construction. Guided keeper assembly 20*d* also includes a plurality of substantially identical fasteners 126, such as cap screws, each of which has a head portion 127, as well as a shank portion 128 which extends through the fastener aperture 122 of an associated flange clamp 121 for securely, yet detachably, connecting base bushing 110 with die shoe 1*d*. Guided keeper assembly 20*d* also includes a retainer ring 130 which is detachably mounted in the groove 115 in base bushing 110 and protrudes radially outwardly of the outer wall 111 of base bushing 110 to a position immediately above and adjacent to the head portions 127 of fasteners 126 to positively prevent fasteners 126 from being inadvertently removed from engagement with the die shoe 1*d*. Guided keeper assembly 20*d* is particularly adapted for use in space restricted areas and applications, because the flange clamps 121 can be readily moved around the circumference of base bushing 110, so as to avoid adjacent blocks and/or die parts.

The illustrated base bushing 110 has a split bushing 30*d*, similar in construction to bushing 30, which is press fit into the interior thereof against inner wall 112. Furthermore, in the illustrated example, mounting flange 116 is positioned axially nearest to upper end 113, although the location can vary substantially in accordance with the specific application.

Figure 29:
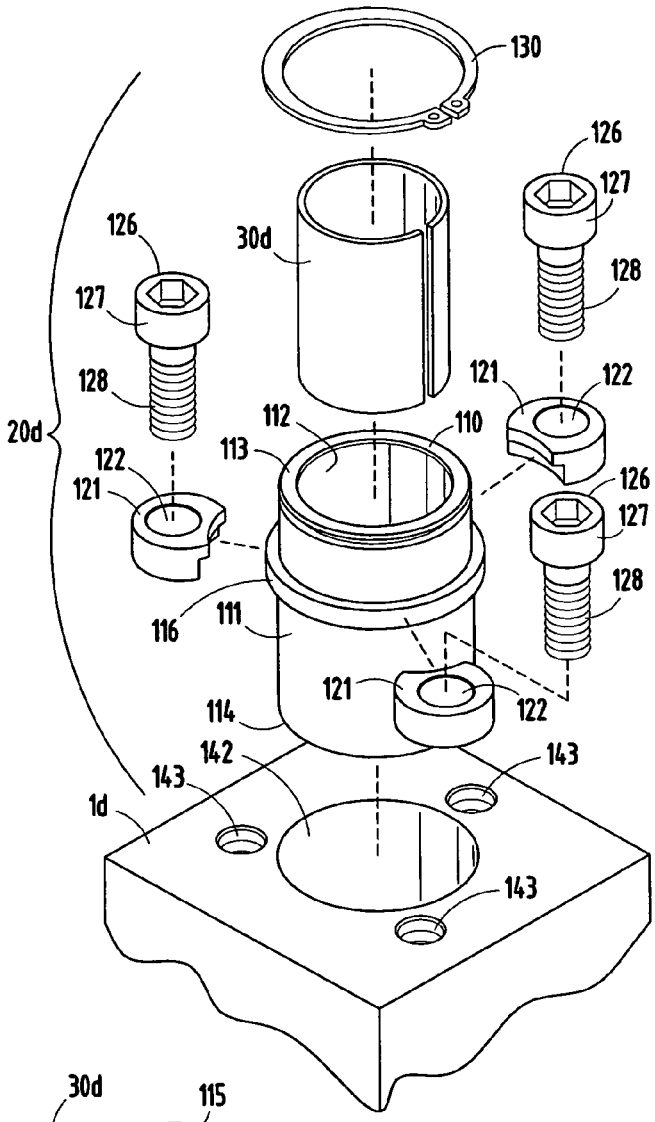
FIG. 29 is an exploded perspective view of the guided keeper assembly shown in FIG. 28.
Figure 30:
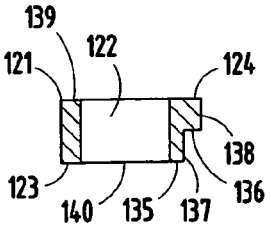
FIG. 30 is a cross-sectional view of a flange clamp portion of the guided keeper assembly shown in FIGS. 28 and 29.
Figure 31:
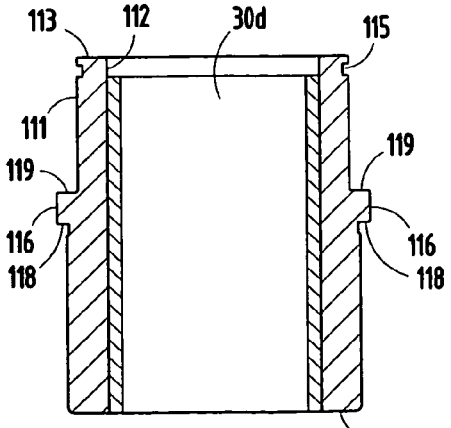
FIG. 31 is a cross-sectional view of a base bushing portion of the guided keeper assembly shown in FIGS. 28-30.
Figure 32:
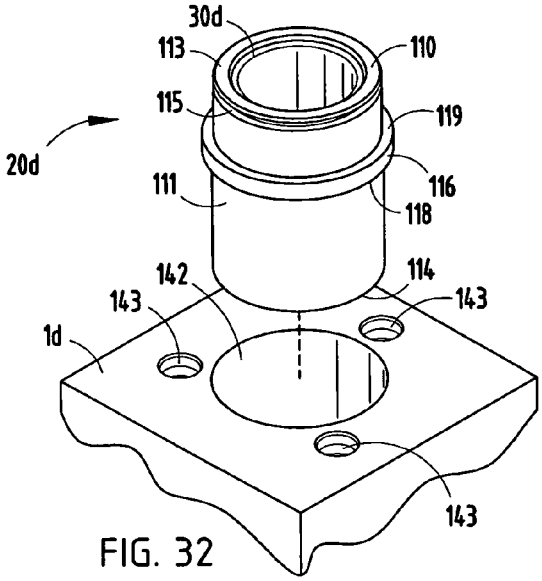
FIG. 32 is a perspective view of the base bushing portion of the guided keeper assembly shown in FIGS. 28-30, illustrated being assembled into an associated die pad.
Figure 33:
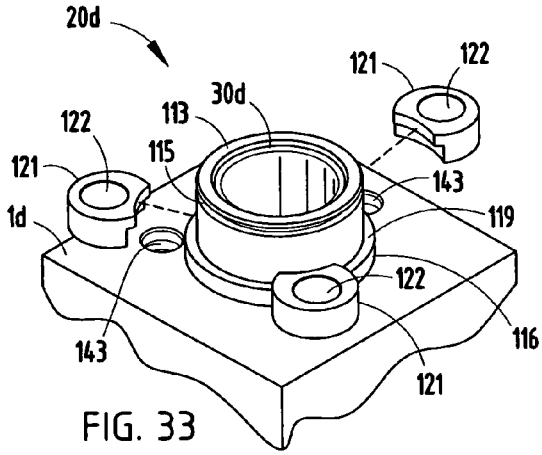
FIG. 33 is a perspective view of the guided keeper assembly shown in FIGS. 28-32, illustrated with the base bushing installed in the die shoe and flange clamps being assembled on the base bushing.

As best illustrated in FIGS. 29 and 33, each of the flange clamps 121 has a substantially identical one-piece construction, comprising a generally circularly-shaped body 135 with fastener aperture 122 extending through the marginal portion 123 of body 135. Lip 124 is formed by a groove 136 in the radially inwardly, lower portion of body 135. As best illustrated in FIGS. 30 and 32-36, the base edge 137 of groove 136 has an arcuate shape similar to the outside diameter of mounting flange 116, while the lip edge 138 has an arcuate shape similar to that of outer wall 111. Body 135 also includes a generally flat upper surface 139 (FIG. 30) against which the head portion 127 of fastener 126 abuts, and a generally flat lower surface 140 disposed generally parallel with upper surface 139, and shaped for abutting contact with the adjacent portion of die shoe 1*d*.

The illustrated retainer ring 130 is in the nature of a metal, split snap ring, which is sufficiently flexible to facilitate insertion into the groove 115 in base bushing 110, but sufficiently rigid in the axial direction to positively prevent fasteners 126 from becoming dislodged from the associated die shoe 1*d*.

Figure 34:
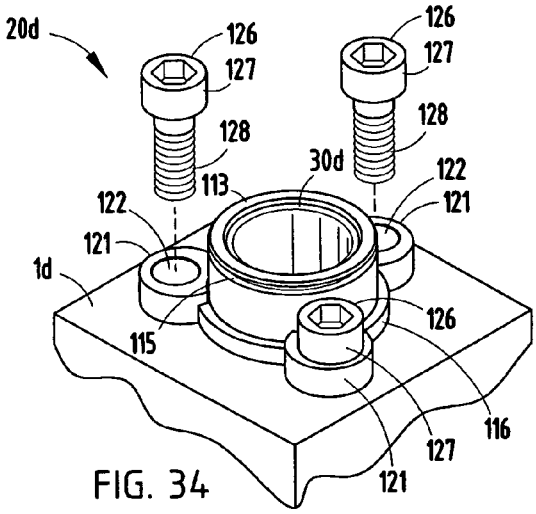
FIG. 34 is a perspective view of the guided keeper assembly shown in FIGS. 28-33, illustrated with threaded fasteners being inserted into the flange clamps.
Figure 35:
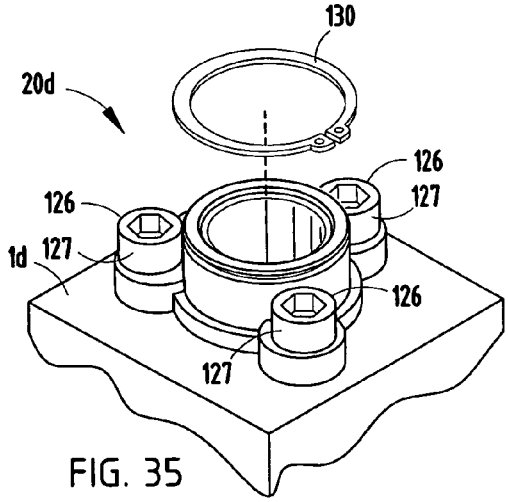
FIG. 35 is a perspective view of the guided keeper assembly shown in FIGS. 28-34, illustrating a retainer ring being assembled on the base bushing mounted in the die shoe.
Figure 36:
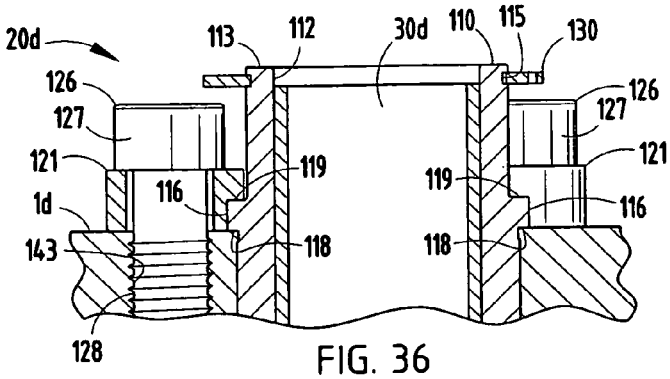
FIG. 36 is a cross-sectional view of the guided keeper assembly shown in FIGS. 28-35 in an assembled condition.

With reference to FIGS. 32-36, guided keeper assembly 20*d* is installed in an associated die shoe 1*d* in the following manner. An aperture 142 is precisely formed in the face of an associated die shoe 1*d* at the location desired, as shown in FIG. 32. The diameter of aperture 142 is selected to closely receive therein and abut the outer wall 111 of base bushing 110, so that the body of base bushing 110 locates the assembly in the associated die plate. A plurality of threaded apertures 143 are then formed in dies shoe 1*d* at a spaced apart location from aperture 142, and arranged in a regularly spaced apart circumferential pattern, as shown in FIG. 32. In the illustrated example, three threaded apertures 143 are formed in die shoe 1*d*. Flange clamps 121 are then assembled onto base bushing 110, such that the lip portions 124 of flange clamps 121 engage the first face 118 of mounting flange 116 and the fastener apertures 122 in fastener clamps 121 are aligned with the threaded apertures 143 in die shoe 1*d*, as shown in FIG. 33. Fasteners 126 are then inserted through the fastener apertures 122 in fastener clamps 121, and anchored securely in threaded apertures 143 in die shoe 1*d*, as shown in FIG. 34. Retainer ring 130 is then mounted in the groove 115 in base bushing 110, as shown in FIGS. 35 and 36 to position the same immediately above and adjacent to the head portions 127 of fasteners 126, so as to positively prevent fasteners 126 from being inadvertently removed or dislodged from engagement with the die shoe 1*d*.

The reference numeral 20*e* (FIGS. 37-39) generally designates yet another embodiment of the present invention having an anti-rotate bolt feature. Since guided keeper assembly 20*e* is similar to the previously described guided keeper assembly 20, similar parts appearing in FIGS. 37-39 and FIGS. 1-21, respectively, are represented by the same, corresponding reference numerals, except for the suffix "e" in the numerals of the latter. The illustrated guided keeper assembly 20*e* includes an anti-rotate bolt 150 that is particularly adapted for use in conjunction with the single fastener type of guide pin shown in FIGS. 19-21, and represented by the reference numeral 32*e* in FIGS. 37-39. However, it is to be understood that anti-rotate bolt 150 can also be used in conjunction with the other guided keeper assembly embodiments disclosed herein.

In the illustrated example, anti-lock bolt 150 has a one-piece construction for improved strength, comprising an oversized, cylindrically-shaped head portion 151 and a threaded shank portion 152. The head portion 151 of anti-rotate bolt 150 has a pair of threaded apertures 153 extending axially completely through marginal portion 154 of bolt head portion 151. A pair of set screws 155 are threadedly mounted in the threaded apertures 153 in the head portion 151 of anti-rotate bolt 150, and include interior free ends 156 which serve to engage the recess 157 in the die shoe 1*e* to prevent inadvertent loosening of anti-rotate bolt 150. In the illustrated example, hardened metal, spherically-shaped balls 158 are positioned in the axial apertures 153 in bolt head portion 151, between the recess 157 in die shoe 1*e* and the free ends 156 of set screws 155. Tightening of set screws 155 urges balls 158 into abutting engagement with the adjacent surfaces of recess 157, so as to form detents therein which serve to prevent inadvertent loosening of anti-rotate bolt 150.

Figure 37:
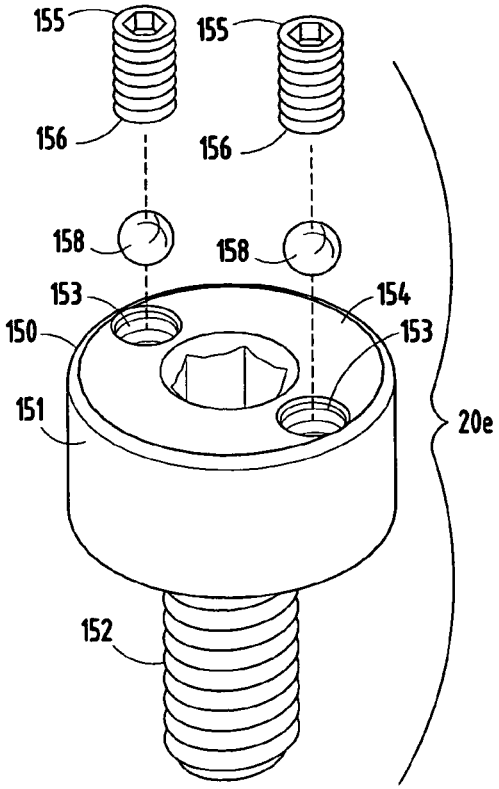
FIG. 37 is an exploded perspective view of a sixth embodiment of the present invention having an anti-rotating bolt.
Figure 38:
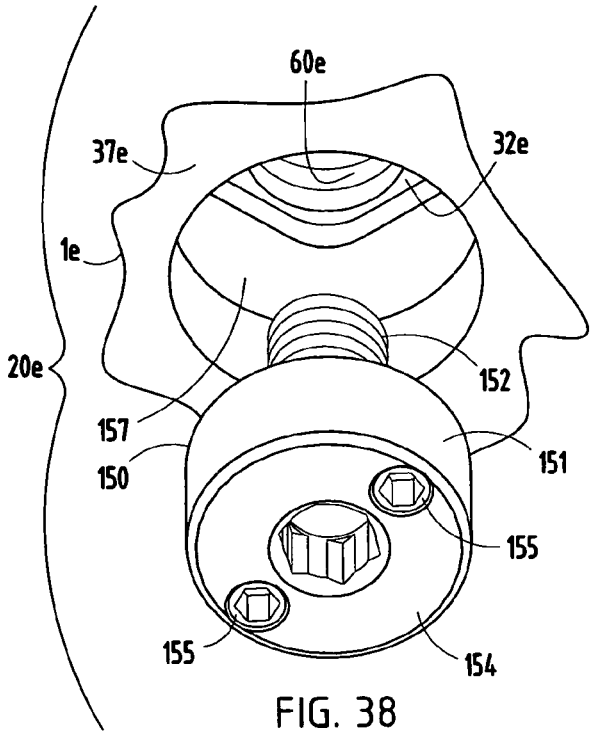
FIG. 38 is a perspective view of the guided keeper assembly shown in FIG. 37, illustrated being connected with an associated guide pin.
Figure 39:
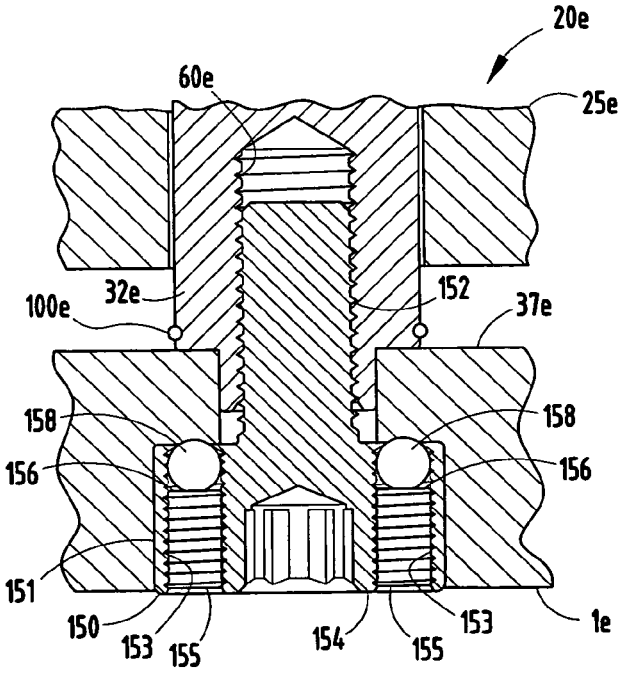
FIG. 39 is a cross-sectional view of the guided keeper assembly shown in FIGS. 37 and 38, illustrated in an installed position.

FIGS. 38 and 39 illustrate the mounting of anti-rotate bolt 150 in an associated guide pin 32*e*, which is of the type having a non-circular shoulder 37*e* with center post 38*e* received in and against the similarly shaped non-circular aperture in die pad 2*e*. Preferably, the locking of anti-rotate bolt 150 is accomplished from the working side of die pad 2*e* for ease of assembly. Hardened balls 158 are inserted into the threaded apertures 153 in bolt head 151, and set screws 155 are threaded into apertures 153 in a loosened condition. The threaded shank portion 152 of anti-rotate bolt 150 is then threaded into the associated threaded aperture 60*e* in the second end 36*e* of guide pin 32*e* and tightened. Next, set screws 155 are then tightened, forcing balls 158 into engagement with the adjacent surfaces of recess 157 and forming detents or recesses therein, so as to prevent inadvertent loosening of anti-rotate bolt 150, as shown in FIG. 37. If anti-rotate bolt 150 is forced loose before the set screws 155 are loosened, such as by using a wrench, balls 158 push the interfering material away, but damage to the anti-rotate bolt assembly is avoided.

Figure 40:
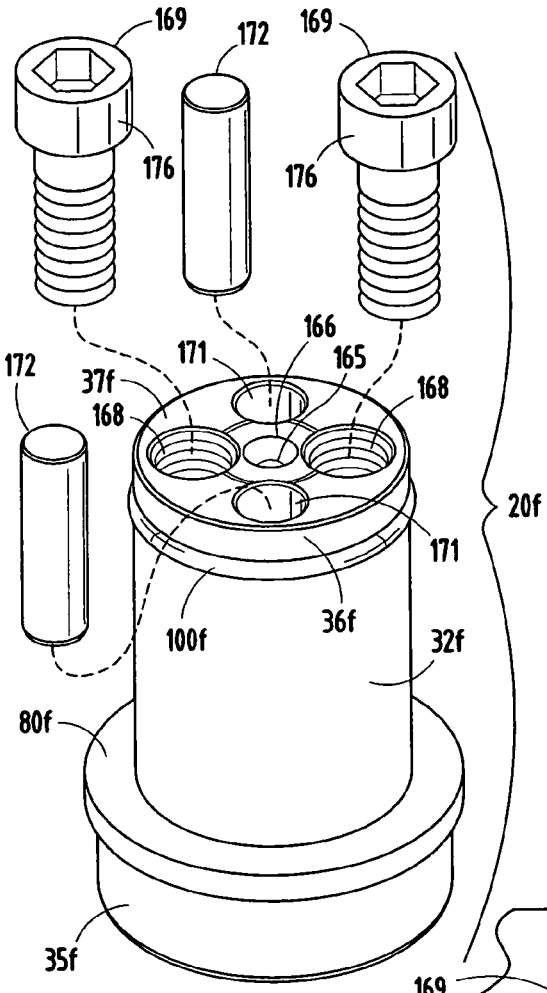
FIG. 40 is a perspective view of a seventh embodiment of the present invention having dowel pin locators.
Figure 43:
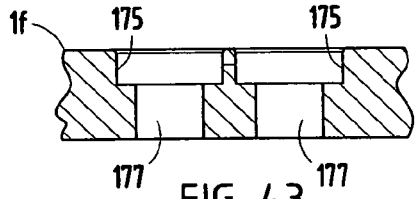
FIG. 43 is a cross-sectional view of the die pad taken along the line XLIII-XLIII, FIG. 41.
Figure 44:
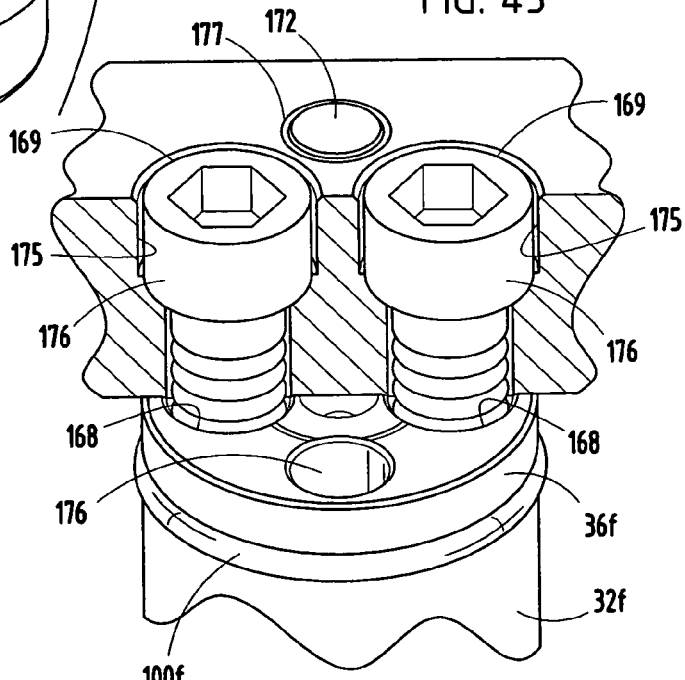
FIG. 44 is a perspective view of the guided keeper assembly shown in FIG. 40, illustrated installed in the die pad.

The reference numeral 20*f* (FIGS. 40-44) generally designate another embodiment of the present invention, having a combination bolt and dowel guide pin connection. Since guided keeper assembly 20*f* is similar to the previously described guided keeper assembly 20, similar parts appearing in FIGS. 40-44 and FIGS. 1-18, respectively, are represented by the same, corresponding reference numerals, except for the suffix "f" in the numerals of the latter. The illustrated guided keeper assembly 20*f* has a combination bolt/dowel guide pin connection. More specifically, instead of the center post 38 type of guide pin connection illustrated in FIGS. 1-18, the shoulder 37*f* of guide pin 32*f* is completely flat. The illustrated guide pin 32*f* has a central aperture 165 disposed concentric with the central axis of guide pin 32*f*, and includes an inwardly tapered upper portion 166. The flat shoulder 37*f* of guide pin 32*f* also includes a pair of axially extending threaded apertures 168 positioned in a diametrically opposite relationship at eccentric locations on shoulder 37*f*, spaced a predetermined distance from central aperture 165. Threaded apertures 168 are adapted to threadedly receive therein a pair of threaded bolts 169, as shown in FIGS. 40 and 44. The flat shoulder 37*f* of guide pin 32*f* also includes a pair of axially extending non-threaded apertures 171 which are positioned diametrically opposite one another in a perpendicular relationship with threaded apertures 168 at eccentric locations spaced apart from central aperture 165. Non-threaded apertures 171 are precisely machined and adapted to receive therein a pair of dowel pins 172 which serve to accurately locate the second end 36*f* of guide pin 32*f* on the associated die pad 2*f*.

Figure 41:
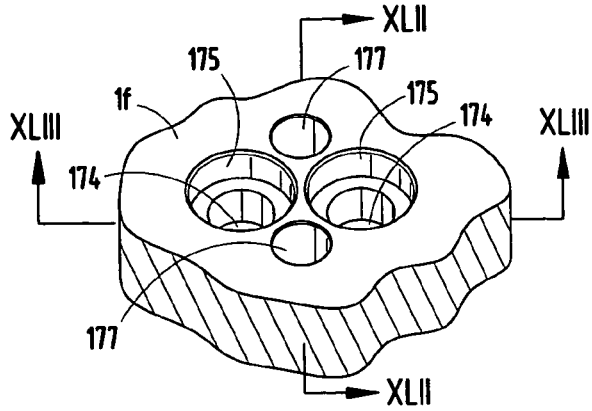
FIG. 41 is a fragmentary perspective view of a die pad which has been drilled to accept the guided keeper assembly shown in FIG. 40.
Figure 42:
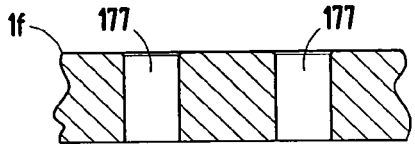
FIG. 42 is a cross-sectional view of the die pad taken along the line XLII-XLII, FIG. 41.

In operation, guided keeper 20*f* is mounted on an associated die pad 2*f* in the following manner. With reference to FIGS. 41-43, a pair of non-threaded apertures 174 are formed completely through die pad 2*f* at locations thereon vertically aligned with the threaded apertures 168 on guide pin 32*f*. Each aperture 174 has an enlarged upper socket portion 175 in which the head 176 of bolt 169 is received. A pair of non-threaded apertures 177 are also formed through die shoe 1*f* in a position vertically aligned with the non-threaded apertures 168 in guide pin 32*f*. Apertures 178 are precisely formed so as to closely receive dowel pins 172 therein. A pair of dowel pins 172 are inserted into the apertures 177 in die shoe 1*f*, as well as the non-threaded apertures 171 in guide pin 32*f* so as to precisely locate guide pin 32*f* on die pad 2*f*. Next, fasteners 169 are inserted through apertures 174 in die pad 2*f*, and anchored securely in the threaded apertures 168 in guide pin 32*f*, thereby securely retaining guide pin 32*f* in the associated die shoe 1*f*.

While many of the guided keeper assemblies 20-20*f* described and illustrated herein have a base 25 fastened to the die shoe 1 and the guide pin 32 fastened to the die pad, as will be appreciated by those skilled in the art, guided keeper assemblies 20-20*f* can be inverted, and otherwise assume a wide variety of different orientations, such that the associated terms used herein, should not be considered as limiting.

Guided keeper assemblies 20, 20*a*, 20*b*, 20*c*, 20*d*, 20*e* and 20*f* each provide a very effective, versatile, uncomplicated and inexpensive mechanism that both precisely aligns a die shoe with an associated die pad, and positively limits reciprocal travel therebetween.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is as follows:

1. In a metal forming die of the type having a die shoe, a die pad mounted a spaced apart distance from said die shoe for mutual reciprocation between converged and diverged positions, and a biasing member disposed between said die shoe and said die pad for biasing the same to said diverged position, the improvement of a guided keeper assembly, comprising:

a base having:

a mounting face shaped to abut an adjacent face of said die shoe;

a connector portion for detachably mounting said base to said die shoe; and a central aperture extending axially through said base;

a guide pin having:

a cylindrically-shaped central portion closely received in said central aperture in said base for precisely guiding reciprocal motion between said die pad and said die shoe;

a first end having an enlarged head shaped to abut said base to positively limit travel between said die shoe and said die pad;

a second end, positioned opposite said first end, and having an alignment member configured to precisely locate said second end of said guide pin on said die pad; and an outwardly opening groove extending circumferentially about said second end of said guide pin;

a retainer ring removably mounted in said groove and protruding radially outwardly of said second end of said guide pin to securely, yet detachably, retain said base on said guide pin between said enlarged head and said retainer ring in an assembled condition to facilitate transport and mounting of said guided keeper assembly;

a first fastener operably engaging said connector portion of said base and securely, yet detachably, connecting said base with said die shoe; and a second fastener securely, yet detachably, connecting said second end of said guide pin with said die pad.

2. A metal forming die as set forth in claim 1, wherein:

said retainer ring comprises a resilient ring sized to selectively snap fit into said groove.

3. A metal forming die as set forth in claim 2, wherein:

said retainer ring comprises a flexible O-ring.

4. A metal forming die as set forth in claim 3, wherein:

said groove is positioned axially adjacent to said shoulder to avoid interfering with the reciprocation of said die pad.

5. A metal forming die as set forth in claim 4, wherein:

said O-ring is constructed from a relatively soft material to absorb impact with said base.

6. A metal forming die as set forth in claim 5, including:

a resilient washer disposed on said guide pin between said enlarged head and said mounting face of said base to absorb impact therebetween.

7. A metal forming die as set forth in claim 6, wherein:

said groove has a generally U-shaped configuration.

8. A metal forming die as set forth in claim 7, including:

a bushing mounted in said central aperture of said base.

9. A metal forming die as set forth in claim 8, wherein:

said bushing comprises a split bushing which is press fit into said central aperture of said base.

10. A metal forming die as set forth in claim 9, wherein:

said base comprises a base block having at least one fastener aperture extending axially therethrough to define said connector portion of said base; and said first fastener extends through said fastener aperture in said base block.

11. A metal forming die as set forth in claim 10, wherein:

said die shoe includes a through aperture positioned longitudinally in-line with said guide pin, and having a lateral dimension greater than the lateral dimension of said head of said guide pin to permit reciprocation of said head within said through aperture.

12. A metal forming die as set forth in claim 11, wherein:

said alignment member includes a generally flat shoulder surface on said second end of said guide pin oriented perpendicular with the central axis of said central portion of said guide pin.

13. A metal forming die as set forth in claim 12, wherein:

said alignment member further includes a rigid locating stud projecting perpendicularly outwardly from a central portion of said shoulder and shaped for close reception in a mating alignment aperture in said die pad.

14. A metal forming die as set forth in claim 13, wherein:

said locating stud has a circular lateral cross-sectional shape;

said shoulder includes at least one threaded aperture extending axially therethrough at an eccentric location thereon spaced apart from the center of said shoulder; and including a third fastener extending through said die pad and threadedly anchored in said threaded aperture in said shoulder to positively prevent rotation of said guide pin relative to said die pad.

15. A metal forming die as set forth in claim 13, wherein:

said locating stud has a non-circular lateral cross-sectional shape for close reception in a similarly shaped socket in said die shoe to prevent rotation of said guide pin relative to said die pad, and a generally flat end face with a threaded aperture extending through a center portion thereof; and a second fastener extends through said die pad and is threadedly anchored in said threaded aperture in said end face of said locating stud.

16. A metal forming die as set forth in claim 15, wherein:

said second fastener has a generally cylindrically-shaped head portion with at least one threaded aperture extending axially through a marginal portion thereof, and a threaded shank portion threadedly received in said threaded aperture of said guide pin; and a set screw threadedly mounted in said threaded aperture in the head portion of said second fastener, and including an interior end shaped to abuttingly engage said socket in said die shoe to prevent inadvertent loosening of said second fastener.

17. A metal forming die as set forth in claim 16, including:

a rigid spherical retainer ball positioned in said threaded aperture in said head portion of said second fastener between said set screw and said socket in said die shoe to prevent inadvertent loosening of said second fastener.

18. A metal forming die as set forth in claim 17, wherein:

said base comprises a base bushing having:

a generally annular configuration defined by a cylindrically-shaped outer wall, a cylindrically-shaped inner wall, an upper end, and a lower end;

an outwardly opening groove extending circumferentially about said outer wall at a location thereon adjacent to said upper end of said base bushing; and an annularly-shaped mounting flange protruding radially outwardly of said outer wall at a location thereon between said groove and said lower end of said base bushing, and having a radially extending first face configured to abut the die shoe, and an oppositely oriented, radially extending second face; and including at least one flange clamp having a fastener aperture extending through a marginal portion thereof and a radially inwardly projecting lip which abuttingly engages an adjacent portion of said second face of said mounting flange for detachably mounting said base bushing to the die shoe;

a third fastener having a head portion, and a shank portion extending through said fastener aperture in said flange clamp for securely, yet detachably, connecting said base bushing with the die shoe; and a retainer ring detachably mounted in said groove in said base bushing and protruding radially outwardly of said outer wall of said base bushing to a position immediately above and adjacent to said head portion of said third fastener to positively prevent said third fastener from being removed from engagement with the die shoe.

19. A metal forming die as set forth in claim 1, wherein:

said second fastener has a generally cylindrically-shaped head portion with at least one threaded aperture extending axially through a marginal portion thereof, and a threaded shank portion threadedly received in said threaded aperture of said guide pin; and a set screw threadedly mounted in said threaded aperture in the head portion of said second fastener, and including an interior end shaped to abuttingly engage said socket in said die shoe to prevent inadvertent loosening of said second fastener.

20. A metal forming die as forth in claim 1, wherein:

said base comprises a base bushing having:

a generally annular configuration defined by a cylindrically-shaped outer wall, a cylindrically-shaped inner wall, an upper end, and a lower end;

an outwardly opening groove extending circumferentially about said outer wall at a location thereon adjacent to said upper end of said base bushing; and an annularly-shaped mounting flange protruding radially outwardly of said outer wall at a location thereon between said groove and said lower end of said base bushing, and having a radially extending first face configured to abut the die shoe, and an oppositely oriented, radially extending second face; and including at least one flange clamp having a fastener aperture extending through a marginal portion thereof and a radially inwardly projecting lip which abuttingly engages an adjacent portion of said second face of said mounting flange for detachably mounting said base bushing to the die shoe;

a third fastener having a head portion, and a shank portion extending through said fastener aperture in said flange clamp for securely, yet detachably, connecting said base bushing with the die shoe; and a retainer ring detachably mounted in said groove in said base bushing and protruding radially outwardly of said outer wall of said base bushing to a position immediately above and adjacent to said head portion of said third fastener to positively prevent said third fastener from being removed from engagement with the die shoe.

21. A metal forming die as set forth in claim 1, wherein:

said second end of said guide pin includes:

a generally flat, circularly-shaped end face disposed perpendicular with the central axis of said central portion, and having a center disposed concentric with said central axis of said central portion;

a first threaded fastener aperture extending through said end face and axially into said central portion in a perpendicular relationship with said end face at an eccentric location spaced from said center of said end face, and receiving said second fastener therein;

a second threaded fastener aperture extending perpendicularly through said end face and axially into said central portion at an eccentric location spaced apart from said center of said end face, and generally opposite said first threaded fastener aperture, and receiving a third fastener therein; and at least one unthreaded locator aperture extending perpendicularly through said end face and axially into said second end; and including at least one unthreaded locator pin having an interior end thereof closely received in said locator aperture and an exterior end thereof shaped for close reception in an alignment aperture in the die pad to define said alignment member, and precisely, yet detachably, mount said guided keeper assembly.

22. A guided keeper assembly for metal forming dies of the type having a die shoe, a die pad mounted a spaced apart distance from the die shoe for mutual reciprocation between converged and diverged positions, and a biasing member disposed between the die shoe and the die pad for biasing the same to the diverged position, comprising:

a base having:

a mounting face shaped to abut an adjacent face of the die shoe;

a connector portion for detachably mounting said base to the die shoe; and a central aperture extending axially through said base;

a guide pin having:

a cylindrically-shaped central portion closely received in said central aperture in said base for precisely guiding reciprocal motion between the die pad and the die shoe;

a first end having an enlarged head shaped to abut said base to positively limit travel between the die shoe and the die pad;

a second end, positioned opposite said first end, and having an alignment member configured to precisely locate said second end of said guide pin on the die pad; and an outwardly opening groove extending circumferentially about said second end of said guide pin;

a retainer ring removably mounted in said groove and protruding radially outwardly of said second end of said guide pin to securely, yet detachably, retain said base on said guide pin between said enlarged head and said retainer ring in an assembled condition to facilitate transport and mounting of said guided keeper assembly;

a first fastener operably engaging said connector portion of said base and securely, yet detachably, connecting said base with the die shoe; and a second fastener securely, yet detachably, connecting said second end of said guide pin with the die pad.

23. A guided keeper assembly as set forth in claim 22, wherein:

said retainer ring comprises a resilient ring sized to selectively snap fit into said groove.

24. A guided keeper assembly as set forth in claim 23, wherein:

said retainer ring comprises a flexible O-ring.

25. A guided keeper assembly as set forth in claim 24, wherein:

said groove is positioned axially adjacent to said shoulder to avoid interfering with the reciprocation of the die pad.

26. A guided keeper assembly as set forth in claim 25, wherein:

said O-ring is constructed from a relatively soft material to absorb impact with said base.

27. A guided keeper assembly as set forth in claim 26, including:

a resilient washer disposed on said guide pin between said enlarged head and said mounting face of said base to absorb impact therebetween.

28. A guided keeper assembly as set forth in claim 27, wherein:

said groove has a generally U-shaped configuration.

29. A guided keeper assembly as set forth in claim 28, including:

a bushing mounted in said central aperture of said base.

30. A guided keeper assembly as set forth in claim 29, wherein:

said base comprises a base block having at least one fastener aperture extending axially therethrough to define said connector portion of said base; and said first fastener extends through said fastener aperture in said base block.

31. A guided keeper assembly as set forth in claim 30, wherein:

said alignment member includes a generally flat shoulder surface on said second end of said guide pin oriented perpendicular with the central axis of said central portion of said guide pin.

32. A guided keeper assembly as set forth in claim 31, wherein:

said alignment member further includes a rigid locating stud projecting perpendicularly outwardly from a central portion of said shoulder and shaped for close reception in a mating alignment aperture in the die pad.

33. A guided keeper assembly as set forth in claim 32, wherein:

said locating stud has a circular lateral cross-sectional shape;

said shoulder includes at least one threaded aperture extending axially therethrough at an eccentric location thereon spaced apart from the center of said shoulder; and including a third fastener extending through the die pad and threadedly anchored in said threaded aperture in said shoulder to positively prevent rotation of said guide pin relative to the die pad.

34. A guided keeper as set forth in claim 32, wherein:

said locating stud has a non-circular lateral cross-sectional shape, which prevents rotation of said guide pin relative to the die pad, and a generally flat end face with a threaded aperture extending through a center portion thereof; and including a third fastener extending through the die pad and threadedly anchored in said threaded aperture in said end face of said locating stud.

35. A method for making a metal forming die of the type having a die shoe, a die pad mounted a spaced apart distance from the die shoe for mutual reciprocation between converged and diverged positions, and a biasing member disposed between the die shoe and the die pad for biasing the same to the diverged position, comprising:

forming a base with a mounting face shaped to abut an adjacent face of the die shoe, at least one connector portion for detachably mounting the base to the die shoe, and a central aperture extending axially through a central portion of the base;

forming a guide pin with a cylindrically-shaped central portion shaped for close reception in the central aperture of the base, a first end with an enlarged head shaped to abut the base block to positively limit travel between the die shoe and the die pad, and a second end with an alignment member to precisely locate the second end of the guide pin on the die pad;

forming at least one fastener aperture in the die shoe at a preselected location;

forming an outwardly opening groove circumferentially about the second end of the guide pin;

inserting the central portion of the guide pin into the central opening in the base for precisely guiding reciprocal motion between the die pad and the die shoe;

mounting a retainer ring in the groove on the guide pin, such that the retainer ring protrudes radially outwardly of the second end of the guide pin to securely, yet detachably, retain the base on the guide pin between the enlarged head and the retainer ring in an assembled condition to facilitate transport and mounting of the guided keeper assembly;

engaging a fastener with the connector portion of the base and engaging the same in the fastener aperture in the die shoe to securely, yet detachably, mount the base on the die shoe;

engaging the alignment member on the second end of the guide pin with the die pad to precisely locate the second end of the guide pin in the die pad; and securely, yet detachably, connecting the second end of the guide pin with the die pad.

36. A method as set forth in claim 35, including:

forming a through aperture in the die shoe at a location longitudinally in-line with the guide pin, with a lateral dimension greater than the lateral dimension of the head of the guide pin to permit reciprocation of the head within the through aperture.

37. A method as set forth in claim 36, wherein:

said retainer ring mounting step comprises selecting a resiliently flexible O-ring made from a relatively soft material for the retainer ring, and snap fitting the O-ring into the groove in the guide pin, whereby the O-ring absorbs impact with the base.

38. A method as set forth in claim 37, wherein:

said guide pin forming step includes forming a flat shoulder on the second end of the guide pin; and said groove forming step includes forming the groove at a location on the guide pin that is axially adjacent to the shoulder to avoid interfering with the reciprocation of the die pad.

39. A method as set forth in claim 38, including:

press fitting a split bushing into the central opening of the base to provide a durable bearing surface for said guide pin.

40. A method as set forth in claim 39, including:

prior to said guide pin inserting step, positioning a resilient washer on the guide pin at a location thereon adjacent to the head to absorb impact between the head and the base.

41. A method as set forth in claim 40, wherein:

said base forming step comprises forming a base block, and forming at least one fastener aperture axially through the base block to define the connector portion thereof; and said fastener engaging step comprises inserting the fastener through the fastener aperture in the base block and securely, yet detachably, anchoring the same in the die shoe.

42. A method as set forth in claim 41, wherein:

said guide pin forming step includes forming a rigid locating stud which projects perpendicularly outwardly from the center of the shoulder to define at least a portion of the alignment member; and said alignment member engaging step includes forming an alignment aperture in the die pad, and telescopingly inserting the locating stud on the guide pin into the alignment aperture in the die pad.

43. A method as set forth in claim 42, wherein:

said locating stud forming step includes forming the locating stud with a circular lateral cross-sectional shape; and including forming at least one threaded aperture axially through the shoulder at an eccentric location thereon spaced apart from the center of the shoulder; and inserting a third fastener through the die pad and threadedly anchoring the same in the threaded aperture in the shoulder to positively prevent rotation of the guide pin relative to the die pad.

44. A method as set forth in claim 42, wherein:

said locating stud forming step includes forming the locating stud with a non-circular lateral cross-sectional shape, which prevents rotation of the guide pin relative to the die pad, and a generally flat end face with a threaded aperture extending through a center portion thereof; and including inserting a third fastener through the die pad and threadedly anchoring the same in the threaded aperture in the end face of the locating stud.

45. A guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position, comprising:

a base bushing having:

a generally annular configuration defined by a cylindrically-shaped outer wall, a cylindrically-shaped inner wall, an upper end, and a lower end;

an outwardly opening groove extending circumferentially about said outer wall at a location thereon adjacent to said upper end of said base bushing; and an annularly-shaped mounting flange protruding radially outwardly of said outer wall at a location thereon between said groove and said lower end of said base bushing, and having a radially extending first face configured to abut the die shoe, and an oppositely oriented, radially extending second face;

a guide pin having:

a cylindrically-shaped central portion closely received in said inner wall of said base bushing for precisely guiding reciprocal motion between the die pad and the die shoe;

a first end having an enlarged head shaped to abut one of said upper end and said lower end of said base bushing to positively limit travel between the die shoe and the die pad;

at least one flange clamp having a fastener aperture extending through a marginal portion thereof and a radially inwardly projecting lip which abuttingly engages an adjacent portion of said second face of said mounting flange for detachably mounting said base bushing to the die shoe; and a fastener having a head portion, and a shank portion extending through said fastener aperture in said flange clamp for securely, yet detachably, connecting said base bushing with the die shoe; and a retainer ring detachably mounted in said groove and protruding radially outwardly of said outer wall to a position immediately above and adjacent to said head portion of said fastener to positively prevent said fastener from being inadvertently removed from engagement with the die shoe.

46. A guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position, comprising:

a base having:

a mounting face shaped to abut an adjacent face of the die shoe;

a connector portion for detachably mounting said base to the die shoe; and a central aperture extending axially through a central portion of said base;

a guide pin having:

a cylindrically-shaped central portion closely received in said central aperture in said base for precisely guiding reciprocal motion between the die pad and the die shoe;

a first end having an enlarged head shaped to abut said mounting face of said base to positively limit travel between the die shoe and the die pad; and a second end, positioned opposite said first end, and having a shoulder with a rigid center post protruding outwardly therefrom to precisely locate said second end of said guide pin in the die pad; said guide pin having an axially extended threaded aperture through a lower end thereof, and a non-circular plan shape for reception in a similarly shaped socket in the die shoe;

a first fastener engaging said connector portion of said base, and securely, yet detachably, connecting said base with the die shoe;

a second fastener having a generally cylindrically-shaped head portion with at least one threaded aperture extending axially through a marginal portion thereof, and a threaded shank portion threadedly received in said threaded aperture of said guide pin; and a set screw threadedly mounted in said threaded aperture in the head portion of said second fastener, and including an interior end shaped to abuttingly engage the recess in the die shoe to prevent inadvertent loosening of said second fastener.

47. A guided keeper assembly for metal forming dies of the type having a die shoe, a die pad mounted a spaced apart distance from the die shoe for reciprocation between converged and diverged positions, and a biasing member disposed between the die shoe and the die pad for biasing the same to the diverged position, comprising:

a base having:

a mounting face shaped to abut an adjacent face of the die shoe;

a connector portion for detachably mounting said base to the die shoe; and a central aperture extending axially through said base;

a guide pin having:

a cylindrically-shaped central portion closely received in said central aperture in said base for precisely guiding reciprocal motion between the die pad and the die shoe, and having a centrally disposed longitudinal axis;

a first end having an enlarged head shaped to abut said mounting face of said base to positively limit travel between the die shoe and the die pad;

a second end, positioned opposite said first end, and having:

a generally flat, circularly-shaped end face disposed perpendicular with said longitudinal axis of said central portion, and having a center disposed concentric with said longitudinal axis of said central portion;

a first threaded fastener aperture extending through said end face and axially into said central portion in a perpendicular relationship with said end face at an eccentric location spaced from said center of said end face;

a second threaded fastener aperture extending perpendicularly through said end face and axially into said central portion at an eccentric location spaced apart from said center of said end face, and generally opposite said first threaded fastener aperture; and at least one unthreaded locator aperture extending perpendicularly through said end face and axially into said second end; and at least one unthreaded locator pin having an interior end thereof closely received in said locator aperture and an exterior end thereof shaped for close reception in an alignment aperture in the die pad to precisely, yet detachably, mount said guided keeper assembly thereon.

48. A guided keeper assembly as set forth in claim 47, wherein:

said locator aperture comprises a single aperture disposed concentric with said center of said end face.

49. A guided keeper assembly as set forth in claim 47, wherein:

said locator aperture comprises a pair of apertures disposed eccentrically on opposite sides of said center of said end face.

* * * * *